US008311459B2

(12) United States Patent
Yamada et al.

(10) Patent No.: US 8,311,459 B2
(45) Date of Patent: Nov. 13, 2012

(54) DEVELOPING APPARATUS, IMAGE FORMING APPARATUS, IMAGE FORMING METHOD, AND TONER

(75) Inventors: Yoichi Yamada, Shiojiri (JP); Tomohiro Aruga, Matsumoto (JP); Daisuke Matsumoto, Matsumoto (JP); Yoshio Nakazawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 323 days.

(21) Appl. No.: 12/722,338

(22) Filed: Mar. 11, 2010

(65) Prior Publication Data

US 2010/0239328 A1 Sep. 23, 2010

(30) Foreign Application Priority Data

Mar. 23, 2009 (JP) ..... 2009-070843

(51) Int. Cl.
*G03G 15/08* (2006.01)
*G03G 9/00* (2006.01)

(52) U.S. Cl. ..... 399/252; 430/110.4

(58) Field of Classification Search ..... 399/252, 399/284, 285; 430/110.1, 110.4
See application file for complete search history.

(56) References Cited

U.S. PATENT DOCUMENTS 5,467,175 A * 11/1995 Takagaki et al. ..... 399/281
5,879,846 A * 3/1999 Watanuki et al. ..... 430/55
7,150,953 B2 * 12/2006 Yamazaki et al. ..... 430/108.3
7,455,942 B2 * 11/2008 Nagatomo et al. ..... 430/108.1
7,582,400 B2 * 9/2009 Nakayama et al. ..... 430/106.2
7,662,530 B2 * 2/2010 Iimura ..... 430/108.1
7,695,882 B2 * 4/2010 Broce et al. ..... 430/108.6
7,846,632 B2 * 12/2010 Nakatani ..... 430/108.7

FOREIGN PATENT DOCUMENTS

JP 58102257 A * 6/1983
JP 58-153972 9/1983
JP 2001-005210 1/2001
JP 2005-331780 12/2005
JP 2006-220967 8/2006
JP 2007-140080 6/2007
JP 2008040256 A * 2/2008
JP 2008-151950 7/2008

* cited by examiner

*Primary Examiner* — Robert Beatty
(74) *Attorney, Agent, or Firm* — Workman Nydegger

(57) ABSTRACT

A developing apparatus includes: a housing which contains toner; a toner supporting roller; and a regulating blade, wherein bias voltage is applied to the regulating blade, the toner includes, an insulating external additive and an electrically-conductive external additive, satisfies any of the following first to third conditions, the first condition: a volume average grain diameter of the electrically-conductive external additive is larger than a volume average grain diameter of the insulating external additive, the second condition: a volume average grain diameter of the electrically-conductive external additive is larger than a volume average grain diameter of the insulating external additive in which coverage in the toner is higher than that of the electrically-conductive external additive, and the third condition: coverage of the electrically-conductive external additive in the toner is higher than coverage of the insulating external additive that is larger in volume average grain diameter than the electrically-conductive external additive.

7 Claims, 14 Drawing Sheets

FIG. 7

| No. | CONTENT [wt%] (COVERAGE [%]) | | | | | EVALUATION |
|---|---|---|---|---|---|---|
| | INSULATING EXTERNAL ADDITIVE (SILICA) | | | CONDUCTIVE EXTERNAL ADDITIVE (TITANIUM OXIDE) | | |
| | D = 12 nm | D = 40 nm | D = 100 nm | D = 20 nm | D = 50 nm | |
| 1 | 1.5 (90) | 1.0 (18) | — | — | — | × |
| 2 | 1.5 (90) | 1.0 (18) | — | 0.5 (10) | — | × |
| 3 | 1.5 (90) | 1.0 (18) | — | 1.0 (21) | — | △ |
| 4 | 1.5 (90) | — | — | 1.0 (21) | — | ○ |
| 5 | 1.5 (90) | 1.0 (18) | — | — | 1.0 (8) | ○ |
| 6 | 1.5 (90) | 1.0 (18) | — | — | 0.5 (4) | △ |
| 7 | 1.5 (90) | — | 0.5 (4) | — | 1.0 (8) | ○ |
| 8 | 1.5 (90) | — | 1.0 (8) | — | 0.5 (4) | × |

COMPARATIVE EXAMPLE

FIG. 13

| No. | KIND OF CONDUCTIVE EXTERNAL ADDITIVE | CONTENT [wt%] (COVERAGE [%]) | | | EVALUATION |
|---|---|---|---|---|---|
| | | INSULATING EXTERNAL ADDITIVE (SILICA) | | CONDUCTIVE EXTERNAL ADDITIVE | |
| | | D = 12 nm | D = 40 nm | | |
| 9 | ZINC OXIDE (D = 20 nm) | 1.5 (90) | 1.0 (18) | 1.0 (21) | ○ |
| 10 | TRANSITION ALUMINA (D = 15 nm) | 1.5 (90) | 1.0 (18) | 1.0 (26) | ○ |
| 11 | TRANSITION ALUMINA (D = 50 nm) | 1.5 (90) | 1.0 (18) | 1.0 (8) | △ |
| 12 | CERIUM OXIDE (D = 40 nm) | 1.5 (90) | 1.0 (18) | 1.0 (18) | ○ |
| 13 | CERIUM OXIDE (D = 100 nm) | 1.5 (90) | 1.0 (18) | 0.5 (8) | ○ |

DEVELOPING APPARATUS, IMAGE FORMING APPARATUS, IMAGE FORMING METHOD, AND TONER

BACKGROUND

1. Technical Field

The present invention relates to a developing apparatus which is provided with a toner supporting roller that supports electrification toner on the surface thereof, an image forming apparatus, an image forming method which forms an image by using the roller, and toner.

2. Related Art

In the technology of developing an electrostatic latent image by toner, in general, toner is supported on the surface of a toner supporting roller formed into an approximately cylindrical shape. In such a kind of technology, since variation inevitably occurs in the electrification amount of toner, in particular, toner having a low electrification amount, or toner electrically charged so as to have the opposite polarity to the original electrification polarity is adhered to the portion of an image, to which toner should not be essentially adhered, so-called fogging thereby occurring. Therefore, there is a technology which, in order to increase the electrification amount of toner which is supported on the surface of a toner supporting roller, uses toner having conductive property as toner, and also, is configured so as to give electric charges to the toner of the surface of the toner supporting roller by disposing an electric charge injecting member applied with bias voltage having the same polarity as the electrification polarity of toner, so as to face the toner supporting roller (for example, FIG. 1 of JP-A-2005-331780).

However, according to an experiment conducted by the inventors of this application, in the technology described in JP-A-2005-331780, since an electric field due to the bias voltage applied to the electric charge injecting member acts in a direction that pushes previously charged toner to the toner supporting roller side, a toner transportation amount on the toner supporting roller is increased. As a result, the amount of toner, into which electric charges are to be injected, is increased, so that an electrification amount as a whole is increased. However, it cannot be said that the effect of suppressing variation of the electrification amount of individual toner is sufficient.

SUMMARY

An advantage of some aspects of the invention is that, in a developing apparatus which is provided with a toner supporting roller which supports electrification toner on the surface thereof, an image forming apparatus, an image forming method which forms an image by using the roller, and toner which is applied to such apparatuses and method, it suppresses variation of the electrification amount of toner on the toner supporting roller, thereby suppressing fogging.

According to a first aspect of the invention, there is provided a developing apparatus including: a housing which contains toner in the interior thereof; a toner supporting roller which is mounted by shafts in the housing and rotates while supporting electrification toner which is supplied from the housing to the surface thereof; and an electrically-conductive regulating blade which comes into contact with the surface of the toner supporting roller, thereby regulating the amount of toner which is supported on the surface of the toner supporting roller, wherein regulating bias voltage having the same polarity as the electrification polarity of the toner is applied to the regulating blade.

According to a second aspect of the invention, there is provided an image forming apparatus including: a toner supporting roller which rotates while supporting electrification toner on the surface thereof; an electrically-conductive regulating blade which comes into contact with the surface of the toner supporting roller, thereby regulating the amount of toner which is supported on the surface of the toner supporting roller; a bias applying section which applies regulating bias voltage having the same polarity as the electrification polarity of the toner to the regulating blade; and a latent image supporting body which is disposed so as to face the toner supporting roller and supports an electrostatic latent image on the surface thereof.

According to a third aspect of the invention, there is provided an image forming method including: supporting toner on the surface of a toner supporting roller; regulating the amount of toner by bringing an electrically-conductive regulating blade applied with regulating bias voltage having the same polarity as the electrification polarity of the toner into contact with the surface of the toner supporting roller; and developing an electrostatic latent image by toner by making a latent image supporting body, on which the electrostatic latent image is supported, to face the toner supporting roller.

According to a fourth aspect of the invention, there is provided toner that is used in a developing apparatus which makes a toner layer to be supported on the surface of a toner supporting roller by bringing an electrically-conductive regulating blade applied with a given regulating bias voltage into contact with the surface of the toner supporting roller.

In the aspects of the invention, the toner has the electrification polarity which is the same polarity as that of the regulating bias voltage, includes, as external additives, an insulating external additive and an electrically-conductive external additive that is higher in conductive property than the insulating external additive, and in addition, satisfies any of the following first to third conditions.

Here, the first condition is that a volume average grain diameter of the electrically-conductive external additive is larger than a volume average grain diameter of the insulating external additive. Also, the second condition is that a volume average grain diameter of the electrically-conductive external additive is larger than a volume average grain diameter of the insulating external additive in which coverage in the toner is higher than that of the electrically-conductive external additive. Also, the third condition is that coverage of the electrically-conductive external additive in the toner is higher than coverage of the insulating external additive that is larger in volume average grain diameter than the electrically-conductive external additive.

In the aspects of the invention, coverage Sa of the external additive in the toner can be expressed by, for example, the following expression:

$$Sa=(Wa\times Dt\times\rho t)/(\pi\times Da\times\rho a)\times 100[\%] \quad \text{(Expression 1)}$$

In the above expression,

Wa: the content (ratio by weight) of an external additive

Dt: the grain diameter of the toner

Da: the grain diameter of an external additive

ρt: the true specific gravity of the toner

ρa: the true specific gravity of an external additive.

Also, in a case where plural kinds of external additives having different grain diameters are used as the insulating external additives, the application of the above-described first to third conditions is made as follows. That is, in the first condition, out of all insulating external additives, the insulating external additive having largest volume average grain diameter is taken as an object of comparison. In the second condition, out of all insulating external additives which are higher in coverage than the electrically-conductive external additive, the insulating external additive having largest volume average grain diameter is taken as an object of comparison. In the third condition, the sum of the coverage of all insulating external additives which are larger in volume average grain diameter than the electrically-conductive external additive is taken as an object of comparison.

In the invention configured as described above, it is possible to suppress fogging by suppressing variation of the electrification amount of toner on the toner supporting roller. Although it will be described in detail later, according to various experiments conducted by the inventors of this application, knowledge was obtained that in the electrification mechanism of electrically charging toner by providing an electric charge by bringing the toner into contact with an electrically-conductive member applied with a bias, regardless of whether or not toner has conductive property as described in the above-mentioned JP-A-2005-331780, existence of a specific external additive provided on the toner surface greatly contributes to electrification of the toner. Specifically, in toner to which fine particles having an appropriate amount of conductive property are provided as the external additives, regardless of the conductive property of a toner mother particle, by injecting electric charges from an electrically-conductive member applied with potential having the same polarity as the normal electrification polarity of toner, into an electrically-conductive external additive on the surface of the toner, it is possible to effectively control the electrification amount of the whole of the toner. On the other hand, an external additive having high insulation property, such as silica or resin bead, acts to impede an electrification amount control function by such an electrically-conductive external additive.

From this, it was found that when using in combination toner which includes an electrically-conductive external additive and an insulating external additive, and toner layer regulation by the regulating blade applied with regulating bias potential, it is effective to set appropriately the ratio of the electrically-conductive external additive and the insulating external additive. Specifically, by setting the ratio to be the relationship satisfying any of the above-mentioned first to third conditions, it becomes possible to suppress variation of the electrification amount of toner, thereby suppressing fogging.

As the electrically-conductive external additive having such a function, titanium oxide, aluminum oxide (in particular, transition alumina), zinc oxide, cerium oxide, tin oxide, and strontium titanate are confirmed up to now, and it is preferable that the toner include at least one of them.

Also, the toner supporting roller may also be, for example, a roller that is formed in its surface with a plurality of convex portions, the top surface of each of which constitutes a portion of the same cylindrical surface, and concave portions surrounding the convex portion. Since the surface shape of the toner supporting roller is managed by the combination of the toner supporting roller having such a structure and the regulating blade applied with regulating bias voltage, it is possible to manage the toner transportation amount on the surface with high precision. Also, it is possible to obtain excellent image quality by suppressing variation of the electrification amount of toner transported, in this way.

In this case, it is preferable that a toner layer which is supported on the convex portion be set to be less than one layer. The toner which is supported on the convex portion receives wind pressure arising from the rotation of the toner supporting roller, thereby easily scattering from the surface of the toner supporting roller. However, if the toner layer is set to be less than one layer, the toner on the convex portion is supported in the state of coming into direct contact with the surface of the toner supporting roller, so that scattering scarcely occurs due to the action of electrostatically strong adhesion. On the other hand, it is preferable that toner which is supported in the concave portion be equal to or more than one layer. In particular, in a case where toner exceeding one layer is supported in the concave portion, a portion out of the toner in the concave portion includes toner which is supported without direct contact with the surface of the toner supporting roller. Such toner easily flies due to an electric field, thereby contributing to improvement in development density. Also, since the toner in the concave portion is supported at a position retreated from the virtual surface of the toner supporting roller, which is constituted of the top surfaces of the convex portions, the toner scarcely receives wind pressure, so that, scattering scarcely occurs.

Also, the toner supporting roller may also be a metallic roller having a surface subjected to amorphous plating treatment. The experiment conducted by the inventors of this application showed that in such a toner supporting roller, it is possible excellently to electrify by friction the toner in the housing. By combination of such a toner supporting roller and the regulating blade applied with regulating bias voltage, it becomes possible to excellently maintain the characteristics of toner which is supported on the surface of the toner supporting roller, thereby obtaining excellent image quality.

Also, in a case where the electrification polarity of the toner is negative polarity, the electrically-conductive external additive may also be an additive with aminosilane film formed on the surface thereof. Since aminosilane has the property of easily carrying positive charges, if aminosilane film is formed on the surface of the electrically-conductive external additive, its contact with the regulating blade applied with regulating bias voltage having the same polarity (namely, negative polarity) as the electrification polarity of toner is easy. Therefore, since providing electric charges from the regulating blade to the electrically-conductive external additive is generated with a higher probability, the electrification amount of toner can be effectively improved.

BRIEF DESCRIPTION OF THE DRAWINGS

The invention will be described with reference to the accompanying drawings, wherein like numbers reference like elements.

FIG. 7 is a view showing the evaluation results of the amount of fogging when the compositions of external additives of toner are changed.

FIG. 13 is a view showing the evaluation results related to electrically-conductive external additives other than titanium oxide.

DESCRIPTION OF EXEMPLARY EMBODIMENTS

Figure 1:
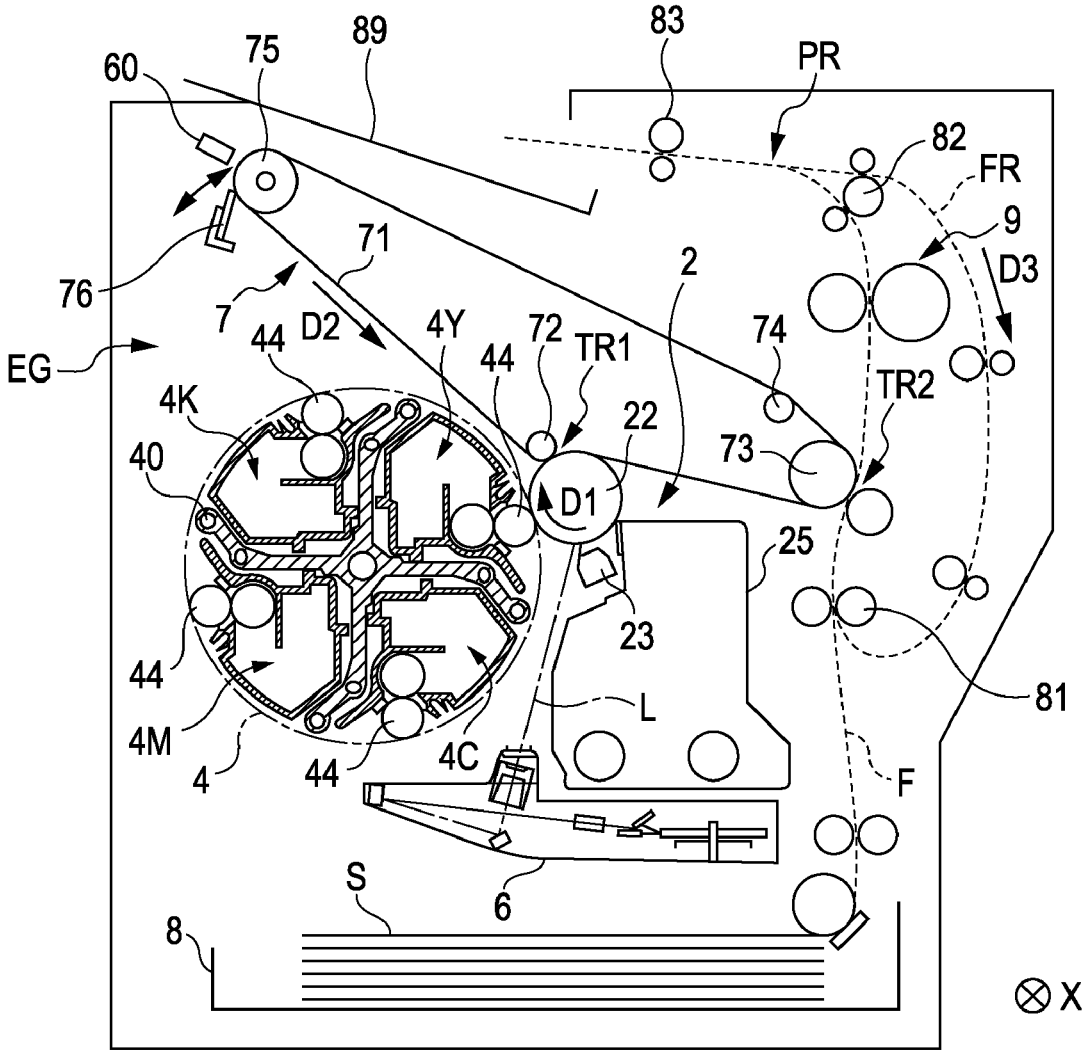
FIG. 1 is a view showing an embodiment of an image forming apparatus to which the invention is applied.
Figure 2:
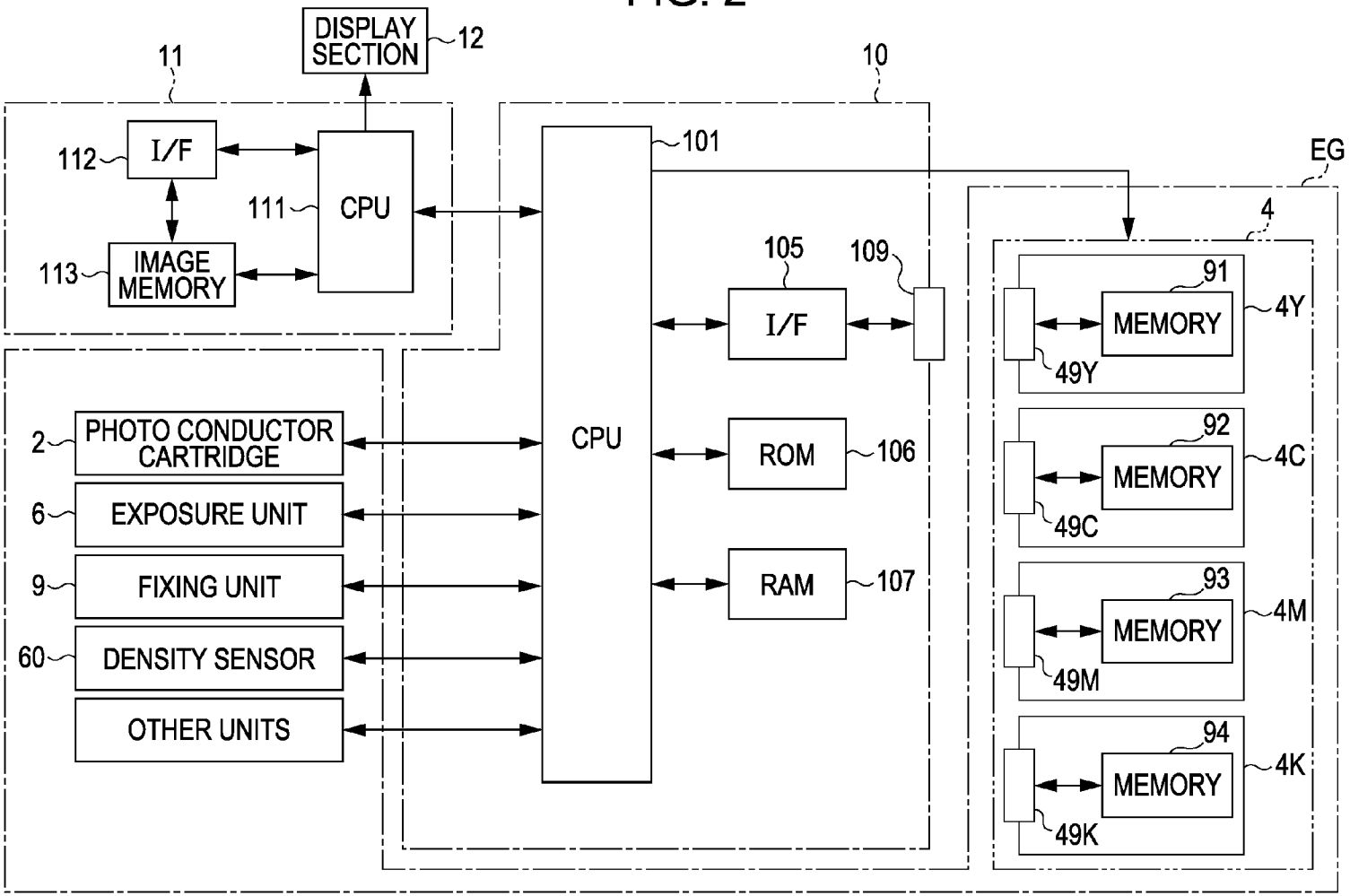
FIG. 2 is a block diagram showing the electrical configuration of the image forming apparatus of FIG. 1.

FIG. 1 is a view showing an embodiment of an image forming apparatus to which the invention is applied. Further, FIG. 2 is a block diagram showing the electrical configuration of the image forming apparatus of FIG. 1. This apparatus is an image forming apparatus which forms a full-color image by superposing toner (developers) of four colors, yellow (Y), cyan (C), magenta (M), and black (K), or forms a monochromatic image by using only toner of black (K). In this image forming apparatus, if an image signal is given from an external apparatus such as a host computer to a main controller 11, a CPU 101 provided in an engine controller 10 controls each section of an engine section EG in accordance with a command from the main controller 11, thereby carrying out a given image forming operation so as to form an image corresponding to the image signal on a sheet S.

In the engine section EG, a photo conductor 22 is provided so as to be able to rotate in an arrow direction D1 of FIG. 1. Further, an electrification unit 23, a rotary developing unit 4, and a cleaning section 25 are disposed around the photo conductor 22 along the rotation direction D1 of the photo conductor. The electrification unit 23 is applied with a given electrification bias and uniformly electrically charges the outer circumference surface of the photo conductor 22 at given surface potential. The cleaning section 25 removes residual toner attached to the surface of the photo conductor 22 after primary transfer and recovers it to a waste toner tank provided in the interior. The photo conductor 22, the electrification unit 23, and the cleaning section 25 integrally constitute a photo conductor cartridge 2, and the photo conductor cartridge 2 is configured so as to be detachably mounted on an apparatus main body as a unit.

Then, a light beam L is irradiated from an exposure unit 6 to the outer circumference surface of the photo conductor 22 electrically charged by the electrification unit 23. The exposure unit 6 irradiates the light beam L to the photo conductor 22 in accordance with the image signal given from the external apparatus, thereby forming an electrostatic latent image corresponding to the image signal.

The electrostatic latent image formed in this way is toner-developed by the developing unit 4. That is, in this embodiment, the developing unit 4 is provided with a support frame 40 provided so as to be rotatable about a rotary shaft which is perpendicular to a plane of FIG. 1, a developing device 4Y for yellow, a developing device 4C for cyan, a developing device 4M for magenta, and a developing device 4K for black. Each of the developing devices is constituted as a cartridge which is detachably mounted on the support frame 40, and contains toner of each color. The developing unit 4 is controlled by the engine controller 10. Then, if on the basis of a control command from the engine controller 10, the developing unit 4 is rotationally driven and any of the developing devices 4Y, 4C, 4M, and 4K is selectively positioned at a given development position which faces the photo conductor 22, a developing roller 44 which is provided in the relevant developing device and supports toner of a selected color is disposed so as to face the photo conductor 22 with a given gap kept therebetween, and at the opposed position, toner is provided from the developing roller 44 to the surface of the photo conductor 22. In this way, the electrostatic latent image on the photo conductor 22 becomes a developed image with a selected toner color.

Figure 3:
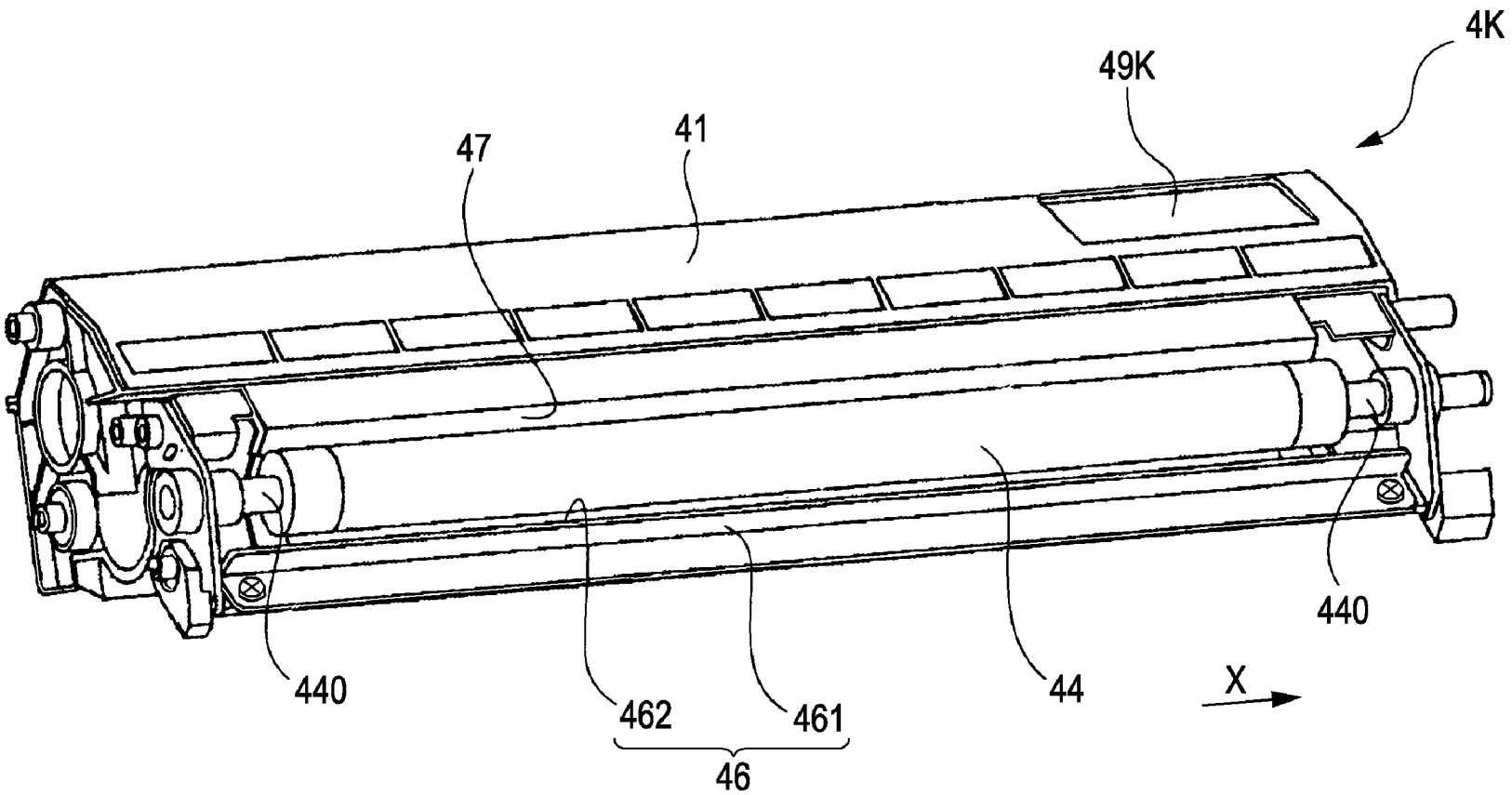
FIG. 3 is a view showing the appearance of a developing device.
Figure 4A:
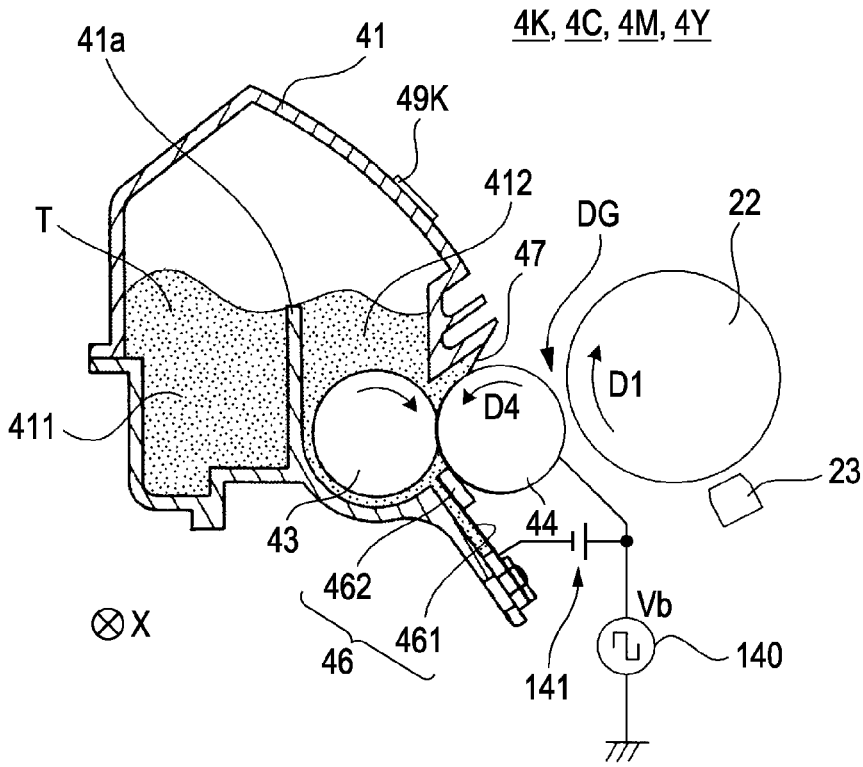
FIGS. 4A and 4B are views showing the structure of the developing device and a waveform of a developing bias.
Figure 4B:
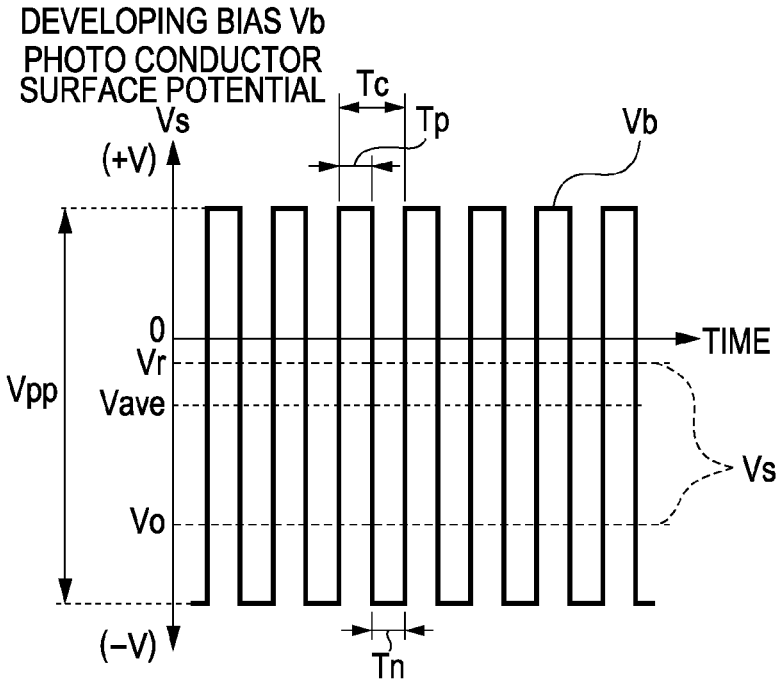

FIG. 3 is a view showing the appearance of the developing device. Also, FIGS. 4A and 4B are views showing the structure of the developing device and a waveform of a developing bias. More specifically, FIG. 4A is a cross-section view showing the structure of the developing device, and FIG. 4B is a view showing the relationship between a waveform of a developing bias and a surface potential of the photo conductor. The developing devices 4Y, 4C, 4M, and 4K all have the same structure. Therefore, here, the configuration of the developing device 4K is explained in more detail with reference to FIGS. 3 and 4A. However, other developing devices 4Y, 4C, and 4M also have the same structure and function.

In the developing device 4K, a supply roller 43 and the developing roller 44 are supported by shafts to be rotatable in a housing 41 which contains nonmagnetic mono-component toner T in the interior thereof. If the developing device 4K is positioned at the development position, the developing roller 44 is positioned so as to face the photo conductor 22 with a developing gap DG kept therebetween, and also, the rollers 43 and 44 are engaged with a rotation driving section (not shown) provided on a main body side, thereby being rotated in a given direction. The supply roller 43 is formed into a cylindrical shape by an elastic material such as foamed urethane rubber or silicone rubber. The developing roller 44 is formed into a cylindrical shape by metal or alloy such as copper, aluminum, or stainless steel. In this embodiment, a roller with a cylindrical surface made of iron and subjected to non-electrolytic nickel phosphorus plating treatment is used. Then, two rollers 43 and 44 rotate while coming into contact with each other, so that toner is rubbed on the surface of the developing roller 44, whereby a toner layer of a given thickness is formed on the surface of the developing roller 44. In this embodiment, negatively charged toner is used, but positively charged toner may also be used.

The internal space of the housing 41 is divided into a first chamber 411 and a second chamber 412 by a partition wall 41*a*. The supply roller 43 and the developing roller 44 are together provided in the second chamber 412, and in accordance with the rotation of these rollers, the toner in the second chamber 412 is supplied to the surface of the developing roller 44 while flowing and being agitated. On the other hand, the toner stored in the first chamber 411 is isolated from the supply roller 43 and the developing roller 44, so that it does not flow by the rotation of these rollers. The toner is mixed with the toner stored in the second chamber 412, and agitated by the rotation of the developing unit 4 with the developing devices held therein.

In this manner, in the developing device, the interior of the housing is divided into two chambers, and the supply roller 43 and the developing roller 44 are surrounded by the side walls and the partition wall 41*a* of the housing 41, so that the second chamber 412 having relatively small volume is provided. Therefore, even in a case where the remaining amount of toner has been reduced, toner is efficiently supplied in the vicinity of the developing roller 44. Further, since a configuration is made such that the supply of toner from the first chamber 411 to the second chamber 412 and the agitation of the whole toner are performed by the rotation of the developing unit 4, an auger-less structure with an agitation member (auger) for the agitation of toner omitted in the interior of the developing device is realized.

Further, in the developing device 4K, there is disposed a regulating blade 46 for regulating the thickness of a toner layer, which is formed on the surface of the developing roller 44, to a given thickness. The regulating blade 46 is constituted by a plate-like member 461 with elasticity made of a material such as stainless steel or phosphor bronze, and an elastic member 462 made of a resin material such as silicone rubber or urethane rubber and attached to the leading end portion of the plate-like member 461. Electrically-conductive particles such as carbon particles are dispersed on the elastic member 462, so that resistivity thereof is adjusted to about $10^6$ Ωcm. Further, hardness thereof is JIS-A hardness 70 degrees.

The rear end portion of the plate-like member 461 is fixed to the housing 41, and in the rotation direction D4 of the developing roller 44, which is shown by an arrow in FIG. 4A, the elastic member 462 attached to the leading end portion of the plate-like member 461 is disposed so as to be located on the upstream side further than the rear end portion of the plate-like member 461. That is, the regulating blade 46 is mounted such that one side end (rear end portion) is fixed and a leading end portion which is a free end on the opposite side to the end faces the upstream side in the rotation direction D4 of the developing roller 44, and the elastic member 462 comes into elastic contact with the surface of the developing roller 44 in a so-called counter-direction so as to form a regulating nip, thereby finally regulating a toner layer, which is formed on the surface of the developing roller 44, to a given thickness. The contact pressure of the regulating blade 46 with the surface of the developing roller 44, that is, regulating load, is adjusted to 5 gf/cm.

The toner layer formed on the surface of the developing roller 44 in this way is transported in sequence to the opposed position to the photo conductor 22, which has an electrostatic latent image formed on the surface thereof, in accordance with the rotation of the developing roller 44. Then, the developing bias from an electric source 140 for a bias, which is controlled by the engine controller 10, is applied to the developing roller 44. As shown in FIG. 4B, surface potential Vs of the photo conductor 22 is lowered up to the order of residual potential Vr in an exposed portion which is uniformly electrically charged by the electrification unit 23 and then subjected to the irradiation of the light beam L from the exposure unit 6, and becomes approximately uniform potential Vo in a non-exposed portion which is not irradiated with the light beam L. On the other hand, a developing bias Vb which is applied to the developing roller 44 is rectangular-wave alternating-current voltage with direct-current potential superposed, and its peak-to-peak voltage is represented by symbol Vpp. By the application of such a developing bias Vb, the toner supported on the developing roller 44 flies in the developing gap DG, thereby partly adhering to each portion of the surface of the photo conductor 22 in accordance with the surface potential Vs thereof, so that the electrostatic latent image on the photo conductor 22 is developed as a toner image of the relevant toner color.

As the developing bias voltage Vb, for example, rectangular-wave voltage having a frequency of the order of 3 kHz to 4 kHz at the peak-to-peak voltage Vpp of 1200 V can be used. If, out of a repetition period Tc of an alternating-current component of the developing bias Vb, a period in which electric potential is deflected to the positive side is represented by Tp, and a period in which electric potential is deflected to the negative side is represented by Tn, and also, a waveform duty WD of the developing bias Vb is defined by the following expression, WD=Tp/(Tp+Tn)=Tp/Tc, in this embodiment, a bias waveform is determined such that the relationship of Tp>Tn is established, namely, the waveform duty WD is larger than 50%. Representatively, WD can be set to be about 60%.

Weighted average voltage Vave of the developing bias Vb, in which a direct-current component that occurs due to the waveform duty is added to a direct-current component superposed on the rectangular-wave alternating-current voltage, can be set to be a necessary value for obtaining a given image density, because a difference in potential between it and the residual potential Vr of the photo conductor 22 becomes a so-called developing contrast, thereby affecting image density. Representatively, it can be set to be, for example, about −200 V.

In addition, although the details will be described later, in this embodiment, an electric source 141 for a regulating bias is connected between the metallic plate-like member 461 constituting the regulating blade 46 and the developing roller 44, and a given regulating bias voltage is applied to the elastic member 462 having conductive property.

Further, in the housing 41, there is provided a seal member 47 which comes into pressure-contact with the surface of the developing roller 44 on the downstream side further than the opposed position to the photo conductor 22 in the rotation direction of the developing roller 44. The seal member 47 is a band-like film which is formed by a resin material with softness such as polyethylene, nylon, or fluorine resin and extends along a direction X parallel to the rotary shaft of the developing roller 44. One side end portion of the seal member in a short side direction (a direction along the rotation direction of the developing roller 44) perpendicular to the longitudinal direction X is fixed to the housing 41, and the other side end portion comes into contact with the surface of the developing roller 44. The other side end portion comes into contact with the developing roller 44 so as to face the downstream side in the rotation direction D4 of the developing roller 44, in a so-called trail direction, thereby guiding the toner remaining on the surface of the developing roller 44, which passed over the opposed position to the photo conductor 22, into the housing 41, and also, preventing the leakage of the toner in the housing to the exterior.

Figure 5:
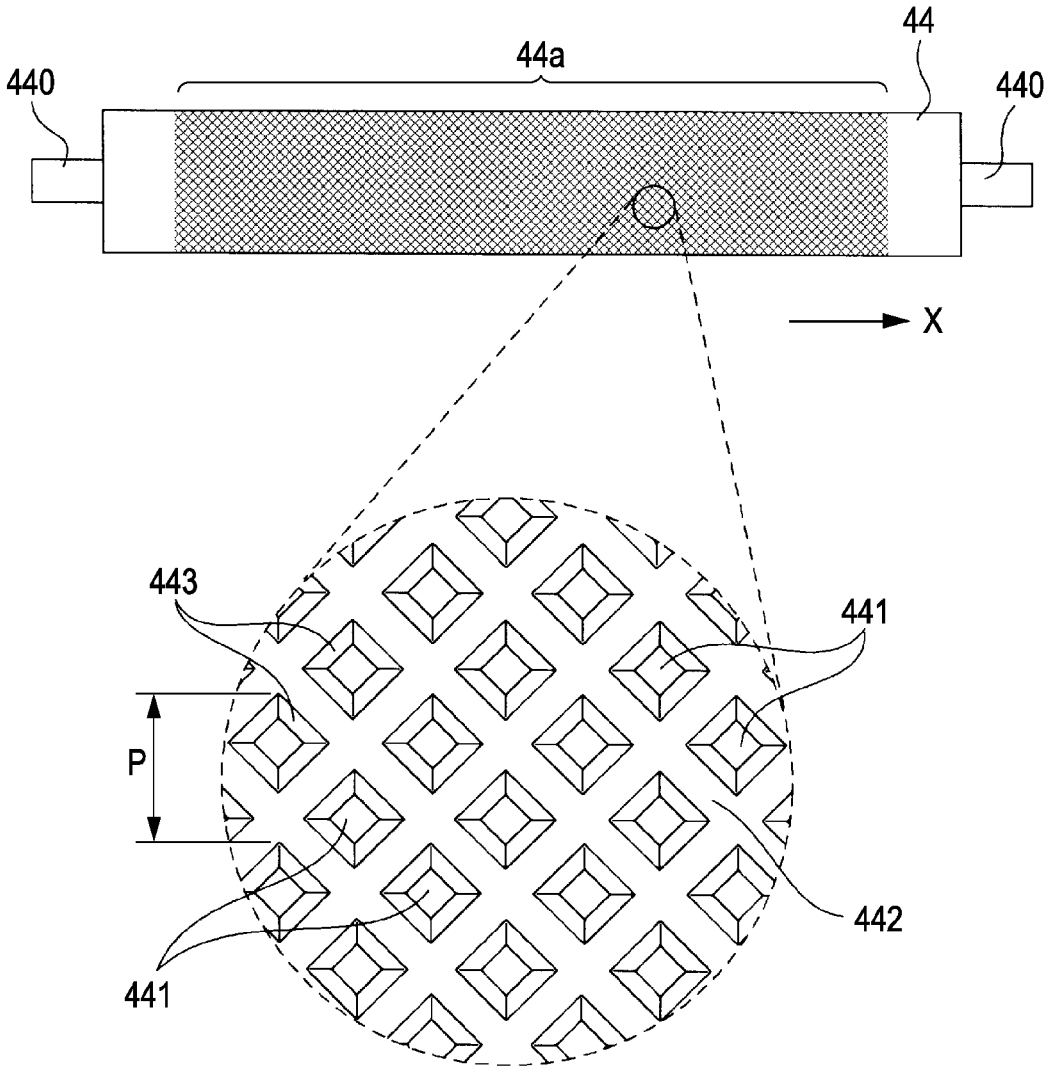
FIG. 5 is a view showing a developing roller and an enlarged view of a portion of the surface thereof.

FIG. 5 is a view showing the developing roller and an enlarged view of a portion of its surface. The developing roller 44 is formed in the form of a roller of an approximately cylindrical shape and has at the opposite ends of its longitudinal direction shafts 440 provided coaxially to the roller. The shafts 440 are rotationally supported by a main body of the developing device, so that the whole developing roller 44 is rotatable. At a central portion 44*a* of the surface of the developing roller 44, a plurality of convex portions 441 which are regularly disposed and concave portions 442 surrounding the convex portions 441 are provided, as shown in the partly enlarged view (in the circle of a dotted line) of FIG. 5.

Each of a plurality of convex portions 441 protrudes toward the front side of the plane of FIG. 5, and the top surface of each convex portion 441 constitutes a portion of a single cylindrical surface which is coaxial to the rotary shaft of the developing roller 44. Further, the concave portions 442 are constituted by continuous grooves surrounding the periphery of the convex portion 441 in a reticulate shape, and the whole concave portion 442 also constitutes one cylindrical surface which is coaxial to the rotary shaft of the developing roller 44 and is different from the cylindrical surface constituted by the convex portions. Further, the convex portion 441 and the concave portion 442 surrounding the convex portion are connected by a gentle flank 443. That is, a normal line of the flank 443 has a component of a direction that faces outwardly (upper direction in the drawing) in a radial direction of the developing roller 44, namely, recedes from the rotary shaft of the developing roller 44.

In this embodiment, an arrangement pitch P of the convex portion 441 on the surface of the developing roller 44 is 80 μm in both the circumferential direction and the axial direction (X direction). The depth of the concave portion 442, that is, a difference in height between the convex portion 441 and the concave portion 442 is 8 μm. Further, a gap (developing gap) between the photo conductor 22 and the developing roller 44 at the development position is set to be 150 μm.

The developing roller 44 having such a structure can be manufactured by a manufacturing method using so-called rolling work described in, for example, JP-A-2007-140080. In this way, the regular and uniform concave and convex portions can be formed in the cylindrical surface of the developing roller 44. Therefore, the obtained developing roller 44 can support the uniform and optimal amount of toner on its cylindrical surface, and also, rolling property (rolling easiness) of toner on the cylindrical surface of the developing roller 44 can also be made uniform. As a result, a local electrification defect or transportation defect of toner can be prevented, so that excellent development characteristics can be realized. Further, since the concave and convex portions are formed by using a die, unlike a common developing roller obtained by blasting work, in the obtained concave and convex portions, the width of the leading end of the convex portion can be made relatively large. Such concave and convex portions have excellent mechanical strength. In particular, since a portion pressed by a die has improved mechanical strength, the obtained concave and convex portions have excellent mechanical strength compared to a portion obtained by processing such as cutting work. The developing roller 44 having such concave and convex portions can exhibit excellent durability. Further, if the width of the leading end of the convex portion of the concave and convex portions is relatively large, a change in shape is small despite abrasion, so that abrupt decrease of a development characteristic can also be prevented, whereby an excellent development characteristic can be exerted over a long period of time.

Returning to FIG. 1, the explanation of the image forming apparatus is continued. A toner image developed in the developing unit 4 in a manner as described above is primarily transferred to an intermediate transfer belt 71 of a transfer unit 7 at a primary transfer region TR1. The transfer unit 7 includes the intermediate transfer belt 71 mounted to pass around a plurality of rollers 72 to 75, and a driving section (not shown) which rotationally drives the roller 73, thereby rotating the intermediate transfer belt 71 in a given rotation direction D2. Also, in the case of transferring a color image to the sheet S, toner images of the respective colors which are formed on the photo conductor 22 are superposed on the intermediate transfer belt 71, thereby forming a color image, and then the color image is secondarily transferred to the sheet S which is taken out one by one from a cassette 8 and transported up to a secondary transfer region TR2 along a transport path F.

At this time, in order correctly to transfer the image on the intermediate transfer belt 71 to a given position on the sheet S, timing of feeding the sheet S to the secondary transfer region TR2 is managed. Specifically, a gate roller 81 is provided on the front side of the secondary transfer region TR2 on the transport path F, and the gate roller 81 is rotated in accordance with timing of circulating movement of the intermediate transfer belt 71, so that the sheet S is fed to the secondary transfer region TR2 at a given timing.

Then, the sheet S on which the color image is formed in this way is subjected to the fixing of the toner image by a fixing unit 9, and then transported to a discharge tray section 89 provided on the upper surface portion of the apparatus main body, through a pre-discharge roller 82 and a discharging roller 83. In addition, in the case of forming images on both faces of the sheet S, at the time when the rear end portion of the sheet S with an image formed on one side face thereof in a manner as described above has been transported up to an inversion position PR on the rear side of the pre-discharge roller 82, the rotation direction of the discharging roller 83 is inverted, so that the sheet S is transported in the direction of an arrow D3 along an inversion transport path FR. Then, the sheet is again loaded on the transport path F in the front of the gate roller 81. However, at this time, the face of the sheet S, which comes into contact with the intermediate transfer belt 71 at the secondary transfer region TR2, so that an image is transferred thereto, is a face opposite to the face to which an image was previously transferred. In this way, images can be formed on both faces of the sheet S.

In addition, as shown in FIG. 2, memories 91 to 94 which store data related to a production lot or a use history of the developing device, the remaining amount of the contained toner, etc., are provided in the developing devices 4Y, 4C, 4M, and 4K, respectively. Also, wireless communication devices 49Y, 49C, 49M, and 49K are provided in the developing devices 4Y, 4C, 4M, and 4K, respectively. Then, as necessary, these wireless communication devices selectively perform non-contact data communication with a wireless communication device 109 provided on the main body side, and by performing the sending and receiving of data between a CPU 101 and each of the memories 91 to 94 through an interface 105, management of various information such as management of articles of consumption related to the developing device is performed. In addition, in this embodiment, the sending and receiving of data is performed without contact by using an electromagnetic means such as wireless communication. However, it is also acceptable that connectors and the like are provided on the main body side and each developing device side and the mutual sending and receiving of data is performed by mechanically mating the connectors and the like.

Also, as shown in FIG. 2, this apparatus is provided with a display section 12 which is controlled by a CPU 111 of the main controller 11. The display section 12 is constituted by, for example, a liquid crystal display and displays given messages for informing a user of guidance for manipulation, a progress status of an image forming operation, occurrence of malfunction of the apparatus, time for replacement of any unit, etc. in accordance with a control command from the CPU 111.

In addition, in FIG. 2, reference numeral 113 denotes an image memory provided in the main controller 11 so as to store an image provided from an external apparatus such as a host computer through an interface 112. Also, reference numeral 106 denotes a ROM for storing an arithmetical program that the CPU 101 executes, control data for controlling the engine section EG, or the like, and reference numeral 107 denotes a RAM which temporarily stores the computing results in the CPU 101 or other data.

In addition, a cleaner 76 is disposed in the vicinity of the roller 75. The cleaner 76 is configured so as to be movable toward or away from the roller 75 by an electromagnetic clutch (not shown). Then, in a state where the cleaner has moved to the roller 75 side, a blade of the cleaner 76 comes into contact with the surface of the intermediate transfer belt 71 wound around the roller 75, thereby removing toner remained and attached to the outer circumferential surface of the intermediate transfer belt 71 after secondary transfer.

In addition, a density sensor 60 is disposed in the vicinity of the roller 75. The density sensor 60 is provided so as to face the surface of the intermediate transfer belt 71 and, as necessary, measures image density of a toner image which is formed on the outer circumferential surface of the intermediate transfer belt 71. Then, on the basis of measurement results of the sensor, in this apparatus, the adjustment of operation conditions of each section of the apparatus, which affects image quality, for example, a developing bias which is applied to each developing device, intensity of the exposure beam L, gradation correction characteristic of the apparatus, and so on is performed.

The density sensor 60 is constituted so as to use, for example, a reflection type photo-sensor and output a signal corresponding to a shading of a region of a given area on the intermediate transfer belt 71. Then, the CPU 101 can detect image density of each portion of a toner image on the intermediate transfer belt 71 by regularly sampling the output signal from the density sensor 60 while circulating the intermediate transfer belt 71.

Next, the toner which is used in this embodiment is explained. The toner is nonmagnetic mono-component toner produced by a known grinding method and has the property of being electrically charged by frictional electrification so as to have negative polarity. Also, the toner has a volume average grain diameter (hereinafter denoted by symbol Dave) of 5 μm and includes, as external additives, a silicon oxide (silica) particle having insulation property, and a titanium oxide (titania) particle as an electrically-conductive external additive that is higher in conductive property than the above-mentioned insulating external additive. How to determine the composition of the toner will be explained below. Also, in the following explanation, unless specifically explained, the physical property values of the toner used in an experiment are as described above.

A number of arts for improving the electrification characteristics of toner on a developing roller by applying a bias to a regulating blade have been proposed in the past, and, as the related arts, besides the above-mentioned JP-A-2005-331780, for example, there are JP-A-2006-220967, JP-A-58-153972, etc. In these documents, it is described that in addition to the application of a bias to a regulating blade, appropriate adjustment of the conductive property of a toner particle is effective for improvement in the electrification amount of toner. However, according to the results of various experiments carried out by the inventors of this application, knowledge differing from this has been obtained.

Figure 6:
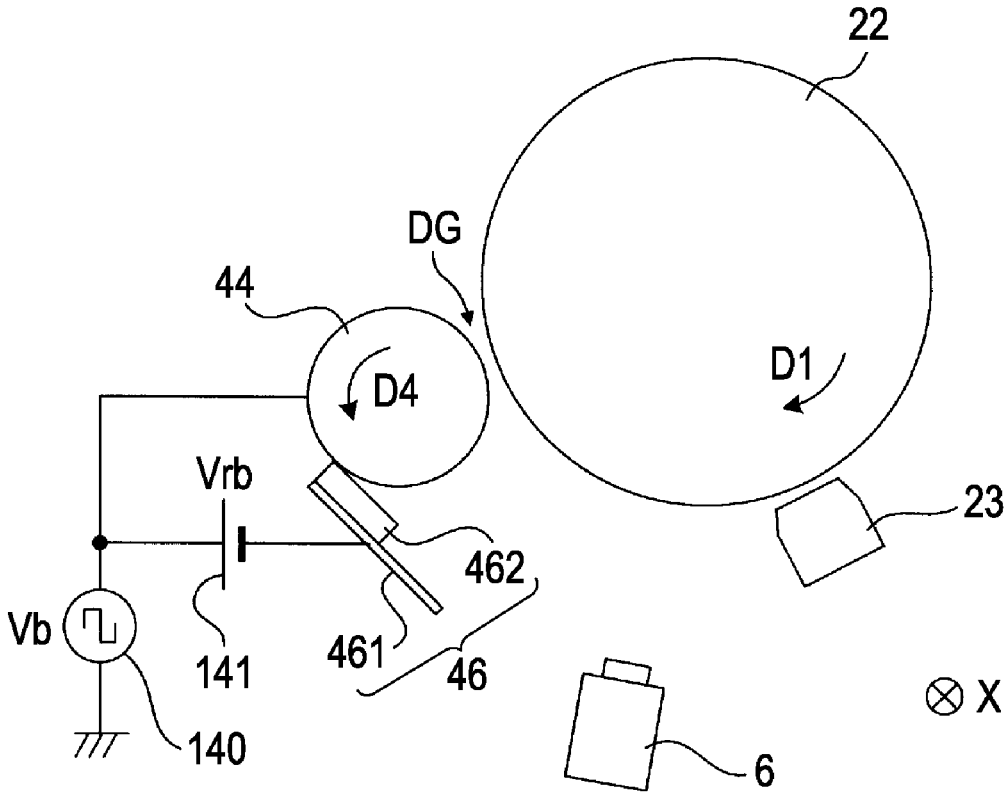
FIG. 6 is a view showing an outline of an experiment conducted by the inventors of this application.

FIG. 6 is a view showing an outline of the experiment conducted by the inventors of this application. In this experiment, in a state where the photo conductor 22 was electrically charged at a given surface potential by the electrification unit 23 while being moved in the rotation direction D1 and exposure by the exposure unit 6 was not performed, the developing bias Vb was applied to the developing roller 44. At this time, the developing roller 44 and the regulating blade 46 were electrically connected to each other through the electric source 141 for a regulating bias, and regulating bias voltage Vrb was applied to the regulating blade 46. In this state, the extent of occurrence of fogging was evaluated by variously varying the regulating bias voltage Vrb, or the composition or the physical property value of the toner.

First, in a case where toner layers which exceeded one layer were supported on the convex portion 441 of the surface of the developing roller 44, or toner layers which exceeded two layers were supported on the concave portion 442 of the surface of the developing roller, regardless of other conditions, scattering of toner from the developing roller 44 or occurrence of fogging was noticeable. So, in the following experiment, by regulating support of toner on the convex portion 441 of the surface of the developing roller 44 by using so-called edge regulation which brings the upstream side edge portion of the elastic member 462 of the regulating blade 46 into contact with the convex portion 441, and also, setting a difference in height between the convex portion 441 and the concave portion 442 to be a value which exceeds one time of a volume average grain diameter of toner and does not exceed 2 times, a toner layer in the concave portion 442 was set to be the order of 1 to 2 times. For this purpose, in the developing roller 44 used in the experiment, a difference in height between the convex portion 441 and the concave portion 442 was set to be 8 μm (≈1.6 Dave).

If a toner layer on the developing roller exceeds one layer, in the toner layer, the toner (contact toner) which is supported in the form of coming into direct contact with the surface of the developing roller, and the toner (non-contact toner) which is supported on the contact toner on the surface without coming into direct contact with the surface of the developing roller are mixed and exist. Although it will be described in detail later, due to a difference in adhesion to the developing roller, the contact toner scarcely departs from the surface of the developing roller, and the non-contact toner easily departs. In this regard, from the viewpoint of prevention of scattering and fogging, it is preferable that a toner layer be constituted of only the contact toner. However, from the viewpoint of the obtaining of sufficient development density, it is preferable that the toner layer include the non-contact toner which easily departs. The ideal state is a state where a toner layer including both contact toner and non-contact toner is supported, and also, measures to prevent scattering and fogging are adopted.

FIG. 7 is a view showing examples of the evaluation results of the amount of fogging when the compositions of the external additives of toner are changed. More specifically, the drawing is a view showing the results in which the extent of the reduction of the amount of fogging was examined carried out by variously changing the compositions of the external additives which are added to toner and applying the regulating bias voltage Vrb to the regulating blade 46 at each composition. The regulating bias voltage Vrb was set to be 300 V. At this time, the regulating blade 46 has negative potential with respect to the developing roller 44. In the "evaluation" column of the drawing, with a case where the regulating blade 46 was set to have the same potential as the developing roller 44, as a reference, when negative regulating bias voltage Vrb was applied, a case showing high reduction of fogging is represented by "O"; a case showing some reduction, "Δ"; and a case showing almost no change, "x".

Toner (1) denoted by Number "1" is toner which contains, as an insulating external additive, 1.5% by weight (coverage: 90%) of silica (hereinafter referred to as "small grain diameter silica") having a volume average grain diameter (denoted by symbol D in the drawing) of 12 nm, and 1.0% by weight (coverage: 18%) of silica (hereinafter referred to as "middle grain diameter silica") having a volume average grain diameter of 40 nm, but does not contain titanium oxide which is an electrically-conductive external additive. In such toner, a fogging reduction effect by the application of the regulating bias voltage Vrb was not obtained. Also, toner (2) to which titanium oxide (hereinafter referred to as "small grain diameter titania") having a volume average grain diameter of 20 nm was added in a small amount (0.5% by weight (coverage: 10%)) was also the same.

On the other hand, in toner (3) in which the content of the small grain diameter titania was increased up to 1.0% (coverage: 21%), a certain level of a fogging reduction effect by the regulating bias voltage was recognized. Also, in toner (4) equivalent to toner in which large grain diameter silica was eliminated from the toner (3), a large fogging reduction effect was observed. Also, in toner (5) in which instead of the small grain diameter titania of the toner (3), titanium oxide (hereinafter referred to as "large grain diameter titania") having a volume average grain diameter of 50 nm was added thereto at 1.0% by weight (coverage: 8%), a higher fogging reduction effect than that of the toner (3) was also obtained. However, in toner (6) in which the content of the large grain diameter titania was lowered, a fogging reduction effect was approximately the same as that of the toner (3).

Also, in toner (7) and toner (8), in which instead of the middle grain diameter silica, silica (hereinafter referred to as "large grain diameter silica") having a volume average grain diameter of 100 nm was added to them, in the toner (7) to which the large grain diameter titania was added in a larger amount than the large grain diameter silica, a high fogging reduction effect was obtained, but, in the toner (8) to which the large grain diameter titania was added in a smaller amount than the large grain diameter silica, improvement was observed.

Figure 8:
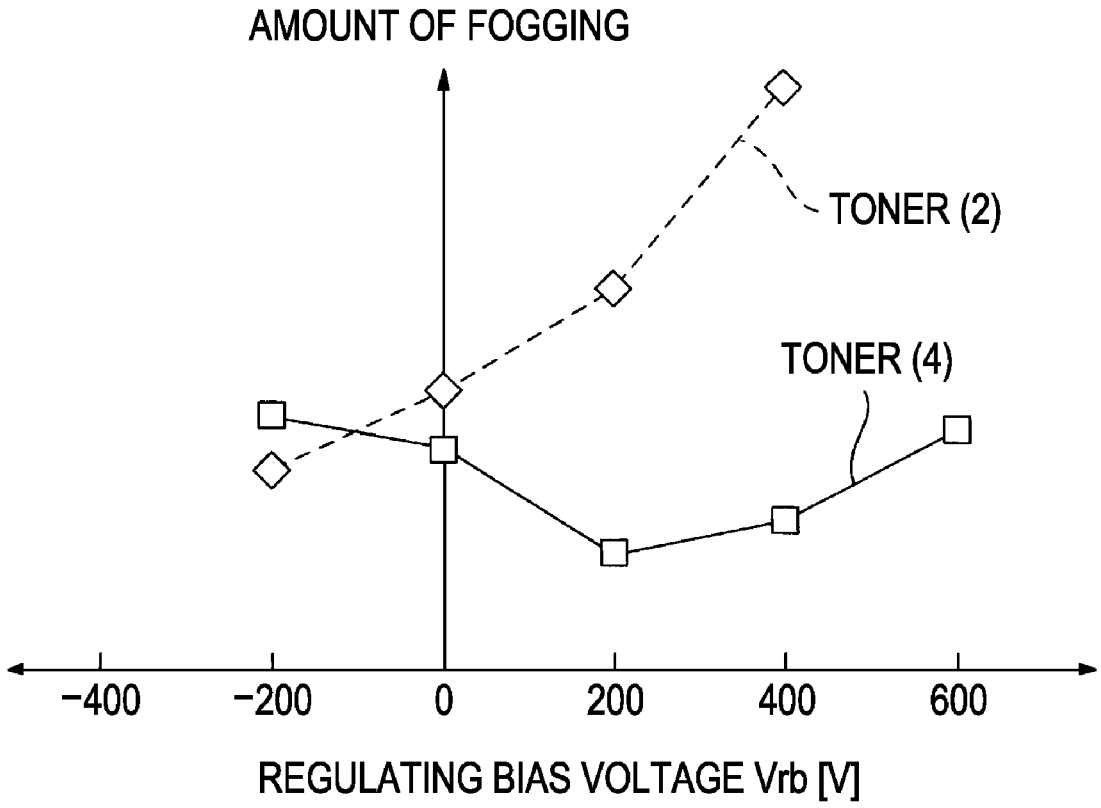
FIG. 8 is a view showing the measurement results of the amount of fogging when regulating bias voltage is changed.

FIG. 8 is a view showing the effect of the regulating bias voltage in two kinds of toner. By using each of the above-mentioned toners, the amount of fogging when the regulating bias voltage Vrb was variously changed was measured. FIG. 8 shows the measurement results in the toner (2) and the toner (4), which are portions thereof. In addition, since the polarity of the regulating bias voltage Vrb is defined as in FIG. 6, the horizontal axis of FIG. 8 shows that the regulating blade 46 has lower potential with respect to the developing roller 44 as going to the right side. In the toner (2) in which the content of titanium oxide is small, if negative potential is applied to the regulating blade 46, the amount of fogging was increased. On the contrary, in the toner (4) in which the large grain diameter silica was eliminated and the amount of titanium oxide was set to be large, by applying negative regulating bias voltage to the regulating blade 46, a distinct fogging reduction effect was obtained. If a bias is set to be larger, the amount of fogging increases again. This is considered as being due to the fact of leak current flows to toner due to high voltage, so that dispersion of the electrification amount occurs.

In this manner, it was found that a fogging reduction effect by the regulating bias voltage Vrb greatly depends on the composition of the external additive which is added to the toner, in this example, the content ratio of a silica particle and a titanium oxide particle. In addition, as described in JP-A-2005-331780, the conductive property of toner itself was also studied. However, when a fogging reduction effect by the regulating bias voltage was evaluated by using toner in which the conductive property of a toner mother particle was varied by changing the content of carbon black pigment which is an electrically-conductive particle, the increase of the conductive property of the toner did not necessarily lead to a good result, rather there was a case where it had an adverse effect.

From the aforementioned, it can be said that in order to reduce scattering or fogging by increasing the electrification amount of toner, it is effective to control the content of titanium oxide as an external additive, rather than the conductive property of the toner. More specifically, it is preferable to add an appropriate amount of titanium oxide as an external additive to the toner, and also, apply appropriate regulating bias voltage having the same polarity as the electrification polarity of toner to the regulating blade 46.

Figure 9A:
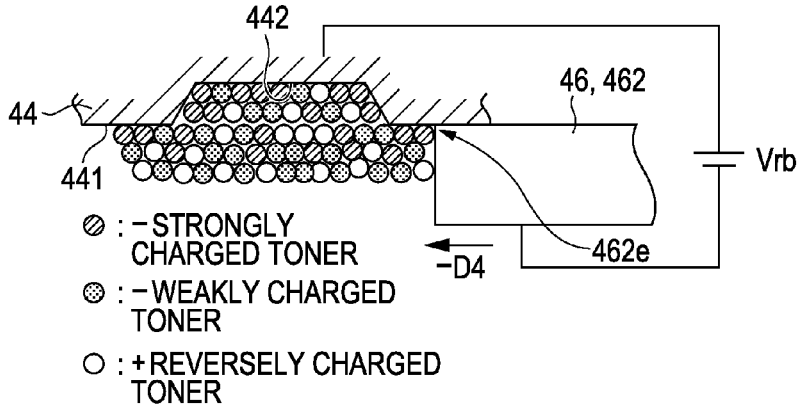
FIGS. 9A and 9D are model diagrams showing behavior of toner in a concave portion.
Figure 9B:
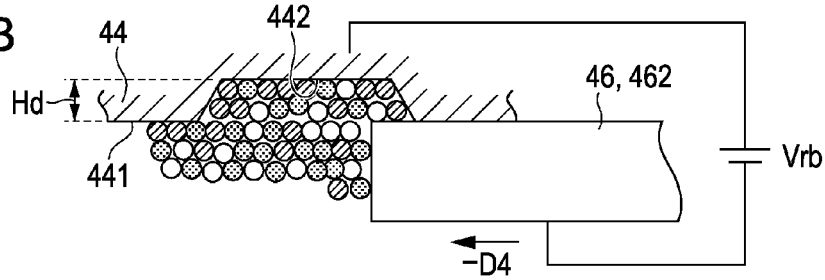
Figure 9C:
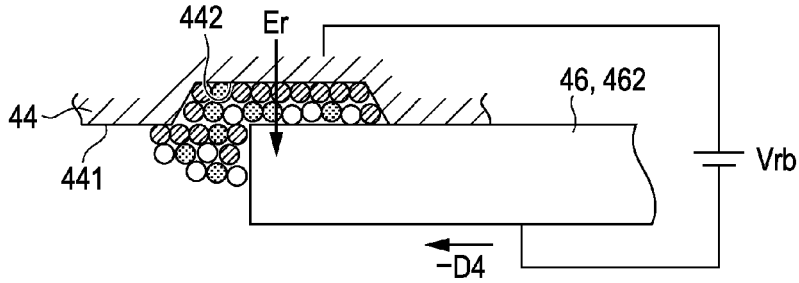
Figure 9D:
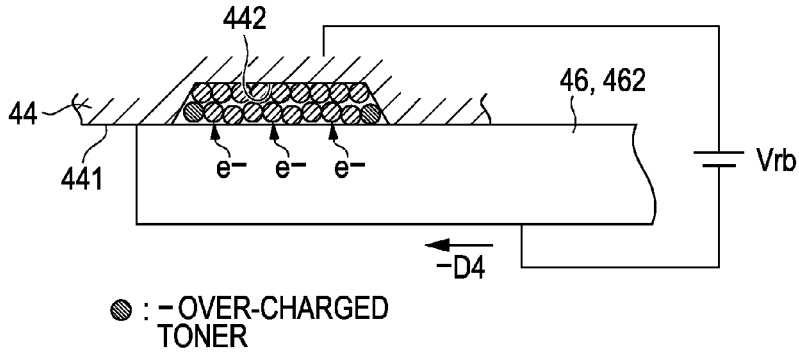
Figure 10:
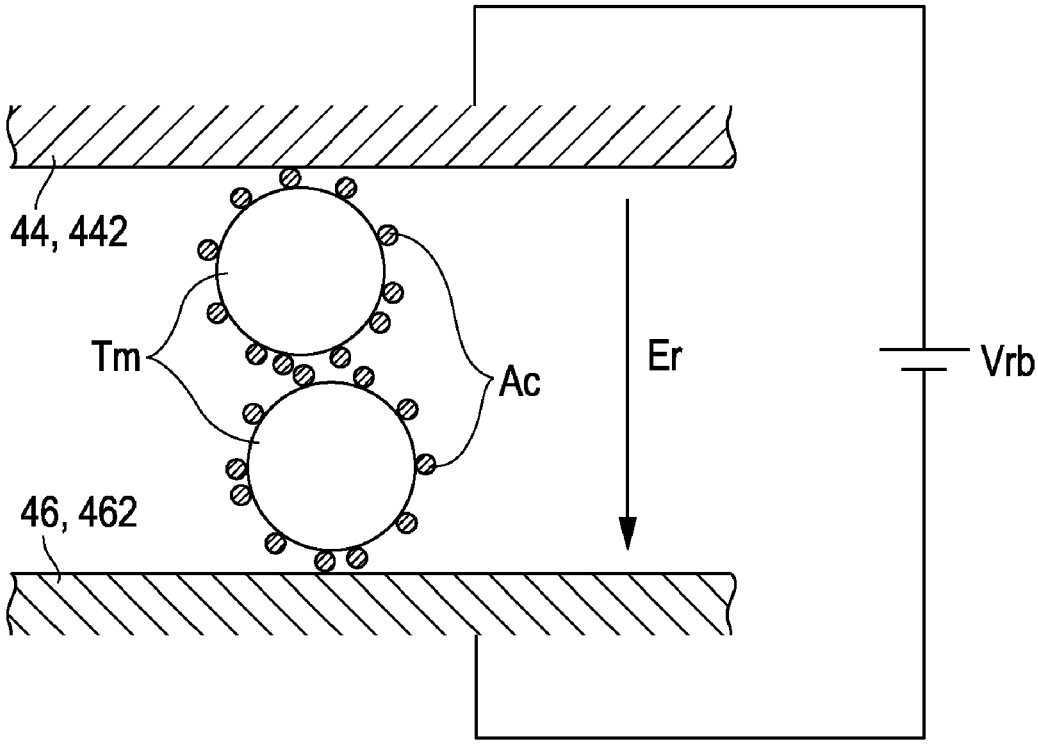
FIG. 10 is a model diagram of the phenomenon of FIGS. 9A and 9D microscopically observed.
Figure 11A:
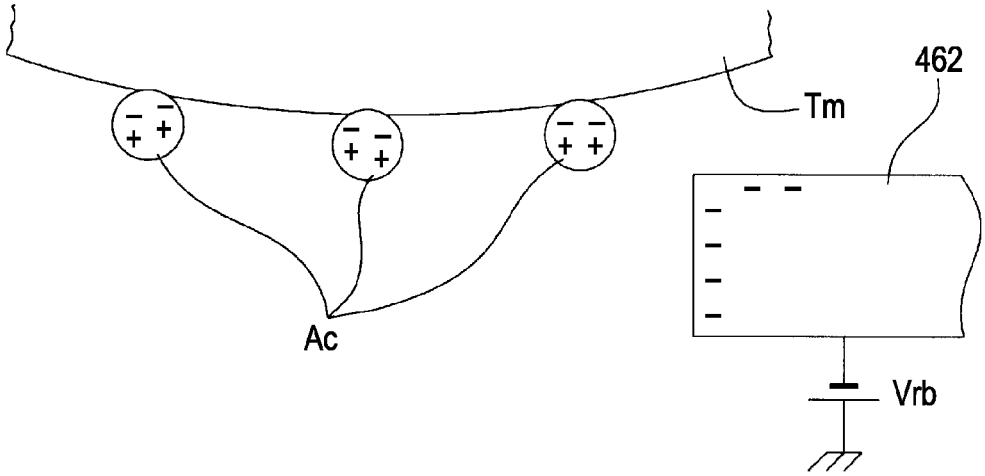
FIGS. 11A to 11C are model diagrams of the phenomenon of FIG. 10 further microscopically observed.
Figure 11B:
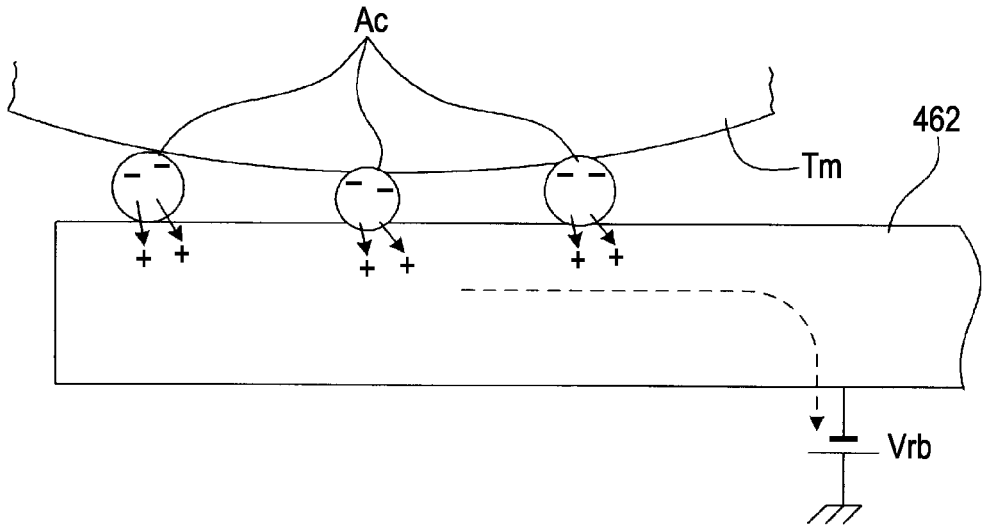
Figure 11C:
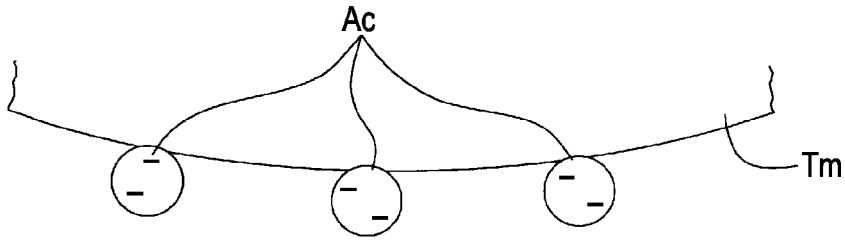

FIGS. 9A to 11C are views showing models of mechanisms in which in this embodiment, the electrification amount of toner is improved. More specifically, FIGS. 9A and 9D are model diagrams showing behavior of toner in the concave portion, FIG. 10 is a model diagram of the phenomenon of FIGS. 9A and 9D microscopically observed, and FIGS. 11A to 11C are model diagrams of the phenomenon of FIG. 10 further microscopically observed. Here, the model is referred to as a "rearrangement and induction charging model".

In toner, electrification variation exists, and the toner in which the electrification amount is high or low, the toner electrically charged so as to have positive polarity opposite to original electrification polarity (negative polarity), and so on are included. In the following description, for convenience sake, out of toner electrically charged so as to have negative polarity which is the original electrification polarity, the toner in which the electrification amount is relatively high is referred to as "strongly charged toner"; the toner in which the electrification amount is low, "weakly charged toner"; and the toner electrically charged so as to have opposite polarity (namely, positive polarity), "reversely charged toner". Also, out of the strongly charged toner, the toner in which the electrification amount is particularly high is referred to as "over-charged toner".

As shown in FIG. 9A, before a layer is regulated by the regulating blade 46, toner particles having different electrification amounts are distributed on the surface of the developing roller 44. Among them, the strongly charged toner in which the electrification amount is relatively high is strongly attracted to the metallic surface of the developing roller 44 due to the action of image force. Therefore, the strongly charged toner highly exists at a position near to the surface of the developing roller 44, whereas the weakly charged toner or the reversely charged toner is pushed by the strongly charged toner, thereby highly existing at a position distant from the surface of the developing roller 44.

As the developing roller 44 rotates in the rotation direction D4 thereof, the regulating blade 46 (more specifically, the elastic member 462 constituting the regulating blade 46) is relatively moved in a −D4 direction. In this embodiment, since edge regulation is performed in which an edge portion 462*e* of the elastic member 462, which corresponds to the most-upstream side in the rotation direction D4 of the developing roller 44, comes into contact with the convex portion 441, toner is excluded from the convex portion 441 in accordance with progress in the −D4 direction of the regulating blade 46, as shown in FIG. 9B. Also, in the concave portion 442, toner which exists above a thickness equivalent to a difference in height, Hd, between the convex portion 441 and the concave portion 442 is also scraped off and excluded. In this embodiment, since a volume average grain diameter of toner is 5 μm, whereas a difference in height, Hd, between the convex portion 441 and the concave portion 442 is 8 μm, a toner layer in the concave portion 442 has a thickness which is larger than one layer and smaller than two layers.

At this time, if the regulating bias voltage Vrb is applied between the developing roller 44 and the regulating blade 46, an electric field (hereinafter referred to as a "regulation electric field") Er of a direction facing from the developing roller 44 toward the regulating blade 46 is formed in the concave portion 442, as shown in FIG. 9C. The regulation electric field Er generates force of a direction that pushes the negatively charged toner to the surface side of the developing roller 44. Since this force more strongly acts on toner having a high electrification amount, strong force that pushes the strongly charged toner toward the surface of the developing roller 44 acts on the strongly charged toner. On the contrary, with respect to the weakly charged toner having a lower electrification amount, or the reversely charged toner, the force is weaker or acts in a reverse direction, and consequently, the strongly charged toner is gathered at a position near to the surface of the developing roller 44, whereas the weakly charged toner or the reversely charged toner moves in a direction that recedes from the surface of the developing roller 44. In this way, rearrangement of toner occurs in the concave portion 442, so that the toner having a high electrification amount is supported at a position near to the surface of the developing roller 44, whereas the toner having a low electrification amount or electrically charged so as to have reverse polarity is supported at a position distant from the surface of the developing roller 44.

In this embodiment, since the toner layer in the concave portion 442 is set to be less than two layers, the weakly charged toner or the reversely charged toner, which are supported at a position distant from the surface of the developing roller 44, is brought into contact with the regulating blade 46, as shown in FIG. 9C. At this time, as shown in FIG. 9D, negative electric charges (represented by symbol "e–") are injected from the regulating blade 46 applied with the regulating bias voltage Vrb (negative voltage with respect to the developing roller 44) to the toner, so that the electrification amount of the weakly charged toner or the reversely charged toner, which were insufficient in electrification amount, is increased. In addition, a portion out of the toner supported in the form of coming into contact with the developing roller 44 is considered as being brought into contact also with the regulating blade 46, and there is a case where such toner becomes over-charged toner due to a further increase of the electrification amount. The over-charged toner is scarcely separated from the surface of the developing roller 44 due to the high electrification amount thereof, and if the over-charged toner is excessively increased, development property is lowered, thereby causing the lowering of density. However, from the viewpoint of the suppression of scattering and fogging, it does not particularly matter.

The mechanism of electric charge injection by the contact with the regulating blade 46 is explained in more detail with reference to FIGS. 10 to 11C. As shown in FIG. 10, a toner particle is in a state where electrically-conductive external additives Ac having a minute particle size are dispersed on the circumference of a mother particle Tm. Then, such toner particles are filled up between the concave portion 442 of the developing roller 44 and the elastic member 462 of the regulating blade 46, and the regulation electric field Er by the regulating bias voltage Vrb is formed therein. Basically, the toner which is in contact with the surface of the developing roller 44 (the concave portion 442) does not come into contact with the regulating blade 46 (the elastic member 462), and conversely, the toner which is in contact with the regulating blade 46 does not come into contact with the developing roller 44.

Here, in a case where the toner mother particle Tm and the external additive Ac have sufficient conductive property, leak current flows through them. It is considered that such current merely passes through the interior of toner and does not contribute to the electrification of toner. However, there is a possibility that an electrically charged charge of toner dissipates to the exterior, so that the electrification amount is disturbed. On the other hand, if the conductive property of the toner mother particle Tm is low, unless the external additives Ac have conductive property and densely cover the entire surface of the mother particle Tm, such leak current almost does not flow. Here, a toner mother particle having no conductive property is considered.

It can be seen that titanium oxide or other metal oxides which are used as the external additive Ac exhibit some conductive property (the order of $10^7$ to $10^8$ Ωcm) in a state of a fine particle, unlike silica having high insulation property, or the like, which is likewise used as the external additive. The toner in this embodiment is toner which is in a state where external additives having such property are added in an appropriate amount, so that the surface of the mother particle Tm is sparsely covered by the external additives Ac.

With respect to the toner which is not in contact with the developing roller 44, a phenomenon occurs in which in accordance with the rotation of the developing roller 44, the regulating blade 46 gradually approaches and comes into contact with the toner, and then, is separated from the toner. Among this process, in the approach process, as shown in FIG. 11A, as the elastic member 462 applied with a negative bias Vrb approaches, in the interiors of the external additives Ac on the surface of the toner mother particle Tm, positive charges are attracted to the elastic member 462 side due to electrostatic induction. If in this state, the external additives Ac come into contact with the elastic member 462, the positive charges move to the elastic member 462 side, as shown in FIG. 11B. This is equivalent to the fact that the negative charges are injected from the elastic member 462 into the external additives Ac. Then, if the elastic member 462 is finally separated, as shown in FIG. 11C, the external additives Ac are in a state where the negative charges are excessive. As a result, it is considered that the electric charges of the external additives Ac are added to the electrically charged charges that the toner mother particle Tm originally had due to frictional electrification, so that the electrification amount of the whole of the toner particle is increased.

According to such a rearrangement and induction charging model, the above-described experiment results can be well explained. That is, regardless of whether or not the toner mother particle Tm is electrically conductive, if as the external additive Ac, an appropriate amount of titanium oxide is added, and also, a bias having the same polarity as the electrification polarity of the toner is applied to the regulating blade 46, the electrification amount of toner is increased, so that fogging is suppressed. This is considered as being due to the fact that the titanium oxide external additives receive negative charges from the regulating blade 46, so that the electrification amount of the whole of a toner particle is increased. In addition, if the conductive property of the toner mother particle becomes higher, the electric charges injected into the external additives are leaked to the mother particle side, so that the external additives cannot hold electric charges (that is, the whole of the toner particle cannot hold electric charges). Therefore, it is considered that the conductive property of toner does not necessarily lead to a fogging reduction effect.

In addition, with regard to influence of silica which is the insulating external additive, the following can be considered. Such an insulating external additive is to impede the provision of an electric charge from the above-mentioned regulating blade 46 to the titanium oxide external additive. In particular, in a case where the grain diameter thereof is large, or a case where the additive amount is great, the influence is high. In the experiment results, when the amount of titanium oxide was set to be greater than that of a silica external additive having a large grain diameter, the improvement in electrification property can be observed, and, in this regard, it is considered that by making the amount of titanium oxide be greater than that of the insulating external additive, electric charges can be more reliably received from the regulating blade 46, and this leads to the improvement in electrification property. From this, the fact that the content ratio of silica which is the insulating external additive and titanium oxide which is the electrically-conductive external additive is related to a fogging reduction effect can also be explained.

Figure 12A:
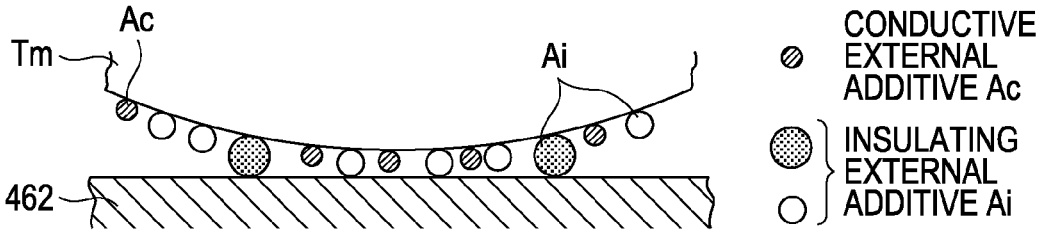
FIGS. 12A to 12D are views schematically showing the surface of toner to which external additives have been added.

FIGS. 12A to 12D are views schematically showing the surface of toner to which the external additives have been added. In these drawings, symbol Tm denotes the toner mother particle. Also, a white circle and a circle having half-tone dots represent an insulating external additive Ai such as silica, for example, and a circle having hatched lines represents an electrically-conductive external additive Ac such as titanium oxide, for example. In addition, the sizes of the circles represent grain diameters of the respective additives. As shown in FIG. 12A as a comparative example, when the grain diameter or the content of the electrically-conductive external additive Ac is smaller than that of the insulating external additive Ai, the electrically-conductive external additive Ac is hindered in its contact with the elastic member 462 of the regulating blade 46 by the insulating external additive Ai. Therefore, the above-mentioned provision of electric charges to the electrically-conductive external additive Ac is impeded.

Figure 12B:
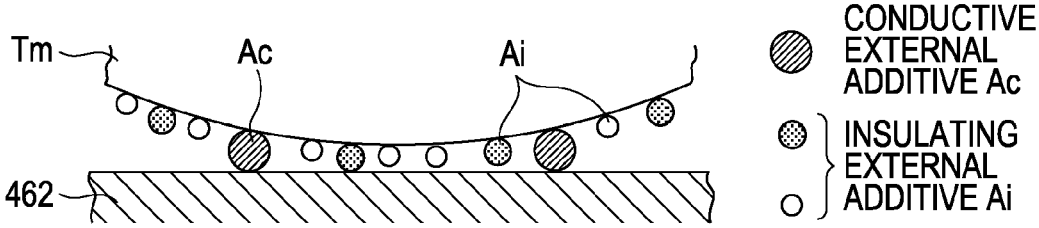

On the other hand, as shown in FIG. 12B, if the grain diameter of the electrically-conductive external additive Ac is larger than that of the insulating external additive Ai, the electrically-conductive external additive Ac can reliably come into contact with the elastic member 462 without being impeded by the insulating external additive Ai. In addition, the toner particles roll on the surface of the developing roller 44, so that it is possible that the electrically-conductive external additives on the surface of the toner evenly come into contact with the elastic member 462, thereby receiving electric charges. Also in a case where plural kinds of insulating external additives are added, if the electrically-conductive external additive Ac is largest, the same effect is obtained.

Figure 12C:
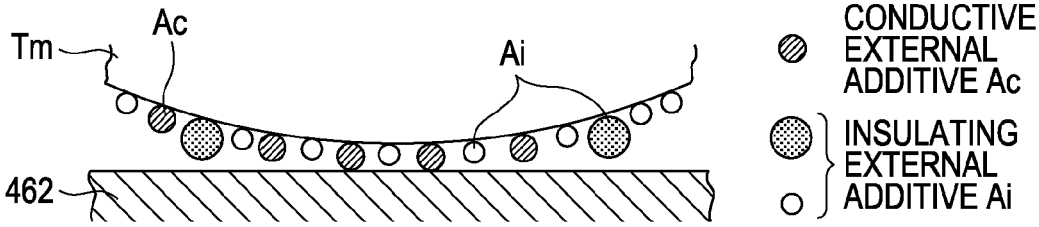

Also, the grain diameter of the electrically-conductive external additive Ac does not need to be necessarily larger than the grain diameters of all insulating external additives Ai. Even in a case where the insulating external additive Ai having a larger grain diameter than that of the electrically-conductive external additive Ac is included, if the amount thereof is small, it does not matter. For example, as shown in FIG. 12C, a state is also acceptable in which the grain diameters of the electrically-conductive external additives Ac are larger than those of the insulating external additives, which are represented by white circles in the drawing and exist in a larger amount than the electrically-conductive external additives Ac, out of the insulating external additives Ai. Also in this state, it is possible that a great number of electrically-conductive external additives Ac come into contact with the elastic member 462, thereby receiving electric charges.

Figure 12D:
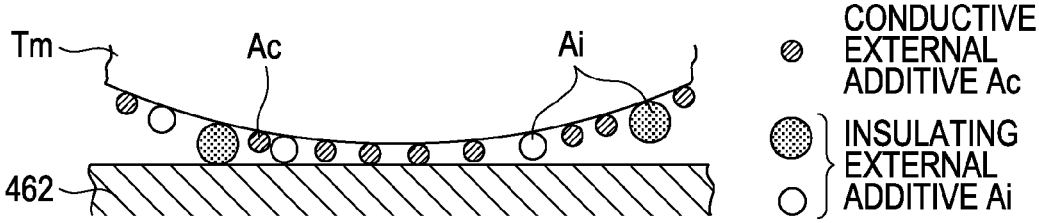

Also, even if the grain diameter of the electrically-conductive external additive Ac is small, as shown in FIG. 12D, also in a state where a number of electrically-conductive external additives Ac exist to such extent as to surpass the distribution of the insulating external additives Ai having a larger grain diameter on the surface of the toner mother particle Tm, many of the electrically-conductive external additives Ac can come into contact with the elastic member 462.

Accordingly, if a state shown in any of FIGS. 12B, 12C, and 12D is realized, increase of the electrification amount of toner due to induction charging to the electrically-conductive external additive, and the fogging amount reduction effect due to this can be obtained. Further, as described above, since such increase of the electrification amount preferentially occurs in the toner which does not come into contact with the developing roller (that is, in which the electrification amount is originally low), variation of the whole of the toner on the surface of the developing roller 44 becomes low, so that it also contributes to improvement in quality of an image which is obtained by development.

Verifying the experiment results of FIG. 7, it can be said that with regard to the content ratio of the insulating external additive Ai (a silica particle) and the electrically-conductive external additive Ac (titanium oxide particle), the coverage has high correlativity, rather than the content represented by % by weight. This also coincides with the fact that in the models of FIGS. 12A to 12D, it is considered that how to coat the surface of the toner mother particle Tm by the external additives, that is, a coating state by the external additives is related to an effect and the weight thereof is not related to the effect in principle.

FIG. 13 is a view showing the evaluation results related to electrically-conductive external additives other than titanium oxide. Here, although the results related to zinc oxide, transition alumina with relatively high conductive property out of aluminum oxide, and cerium oxide, as other electrically-conductive external additives are shown, it was confirmed that besides these metal oxides, tin oxide, strontium titanate, or the like also have the same tendency and effect as those of titanium oxide. These fine particles are smaller in resistivity by the order of 2 digits compared to silica. For example, even with the electrically-conductive external additives which are smaller in grain diameter than the insulating external additive, such as toner (9) and toner (10), if the coverage thereof exceeds that of the insulating external additive having a larger grain diameter, a fogging suppression effect could be obtained. Also, for example, as in toner (13), if the grain diameter of the electrically-conductive external additive is sufficiently larger than that of the insulating external additive, a high fogging suppression effect could be obtained even with a small amount.

From the aforementioned, in a configuration in which the electrification amount of the toner is controlled by using toner which includes both the insulating external additive and the electrically-conductive external additive, and also, the regulating bias voltage Vrb having the same polarity as the electrification polarity of toner is applied to the regulating blade 46 which is brought into contact with the developing roller 44, it can be said that it is preferable that the external additives which are added to the toner satisfy any of the following conditions:

Condition 1: a volume average grain diameter of the electrically-conductive external additive is larger than a volume average grain diameter of the insulating external additive.

Condition 2: a volume average grain diameter of the electrically-conductive external additive is larger than a volume average grain diameter of the insulating external additive in which coverage in the toner is higher than that of the electrically-conductive external additive.

Condition 3: coverage of the electrically-conductive external additive in the toner is higher than coverage of the insulating external additive having a larger volume average grain diameter than that of the electrically-conductive external additive.

According to this, electric charges are efficiently provided from the electrically-conductive elastic member 462 applied with the regulating bias voltage Vrb to the electrically-conductive external additives, so that the electrification amount of toner can be increased. In particular, by increasing the electrification amount of the toner in which the electrification amount is originally low, occurrence of fogging can be suppressed, and also, improvement in image quality can be obtained. For example, the toner (4), the toner (5), and the toner (7) shown in FIG. 7 respectively are toners which satisfy the above-mentioned conditions 1, 2, and 3.

In addition, although the thickness of a toner layer which is supported in the concave portion 442 is not particularly limited, when the toner layer which is supported in the concave portion 442 was set to be larger than one layer and smaller than two layers, scattering of toner or fogging could be suppressed, and further, sufficient development density could be obtained. On the contrary, if the toner layer supported is made too thick, it is observed that scattering or fogging is increased, and this is considered as being due to the fact that the amount of weakly charged toner or reversely charged toner, to which electric charges should be injected, becomes too large, so that toner in which lack of the electrification amount cannot be supplemented is increased. In particular, since in the toner layers which exceed two layers, toner which does not come into contact with any of the developing roller 44 and the regulating blade 46 exists, toner in which it is not possible to increase the electrification amount even in the above-mentioned rearrangement and induction charging model appears. Conversely, if the toner layer is made thin, fogging is suppressed, however, development density is significantly lowered. This is considered as being due to the fact not only that the transportation amount of toner is small, but also that electric charges are further injected to toner which originally has a large electrification amount, thereby leading to over-charging, and consequently, adhesion of toner to the developing roller 44 becomes stronger, so that toner is scarcely transferred onto the photo conductor 22.

In addition, it is also acceptable to make toner which is less than one layer be supported, rather than support of toner on the convex portion 441 being inhibited, as in the above. By making the toner layer to be less than one layer, toner is supported in a state where it comes into direct contact with the top surface of the convex portion 441. Then, the toner is brought into contact with the regulating blade 46, so that the electrification amount is further increased. Therefore, toner is strongly adhered to the top surface of the convex portion 441 due to image force, so that scattering of toner due to the rotation of the developing roller 44 scarcely occurs. Also, if the toner on the convex portion flies in the developing gap DG due to the action of the developing bias Vb, improvement in development density can be expected. Further, even if the flying did not occur, since development density is equivalent to a case where toner is not supported on the convex portion, there is no disadvantage in terms of development density. Rather, by selectively adhering small grain diameter toner to the convex portion 441, toner grain diameter variation in the concave portion 442 is suppressed. Therefore, this method is effective in particular in the case of using toner in which small grain diameter toner is highly included, or toner having large grain-size variation, and so on.

Figure 14A:
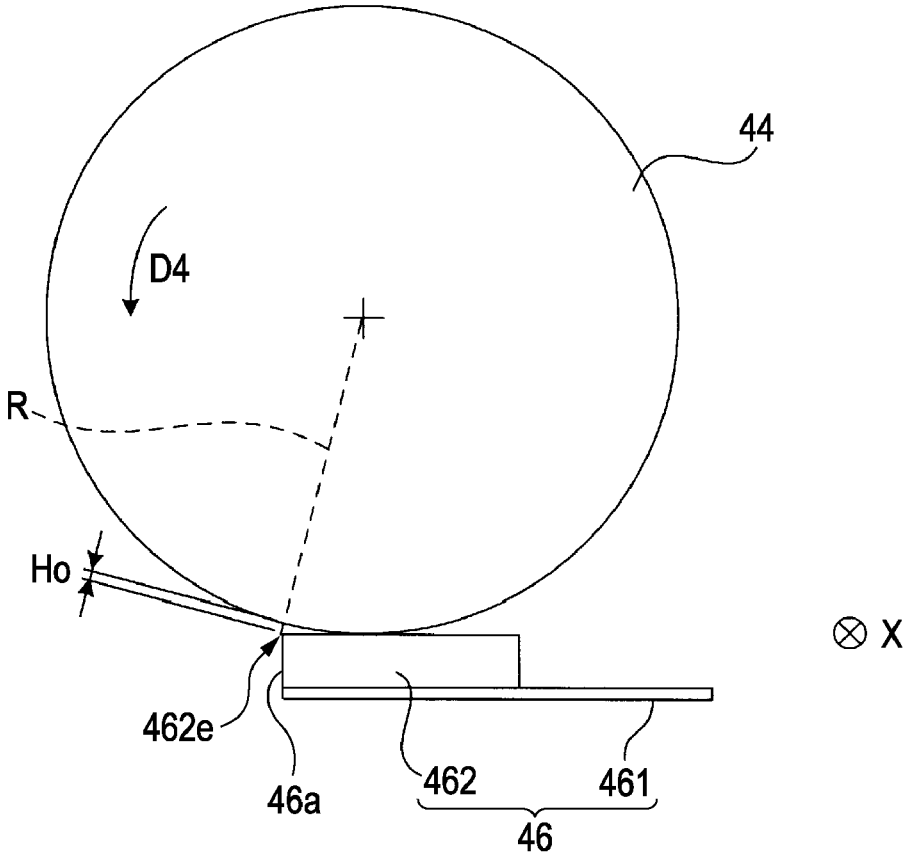
FIGS. 14A and 14B are views showing a modified example which allows support of toner on a convex portion.
Figure 14B:
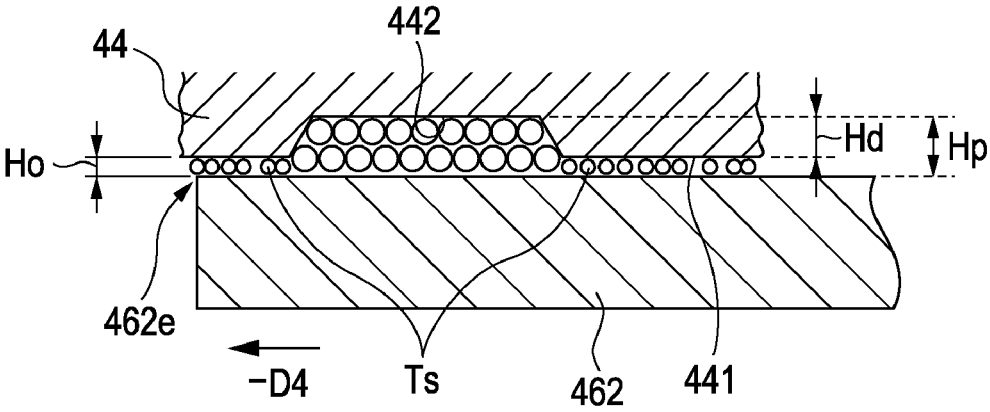

FIGS. 14A and 14B are views showing a modified example which allows support of toner on the convex portion. In the case of allowing support of toner on the convex portion, as shown in FIG. 14A, it is preferable to project an upstream side end portion 46*a* of the regulating blade 46 to a further upstream side (the left in the drawing) and provide a given distance Ho (>0) between an edge portion 462*e* of the elastic member 462 and the surface of the developing roller 44. In this way, an opening portion facing an upstream side is formed between the elastic member 462 and the surface of the developing roller 44, so that toner which has a grain diameter that is equal to or less than the opening height Ho corresponding to the distance between both elements is allowed to be supported on the convex portion. Here, the opening height Ho is defined as a distance along a straight line R which connects the rotation center of the developing roller 44 and the edge portion 462*e* of the elastic member 462.

If the opening height Ho is smaller than the volume average grain diameter Dave of the toner, as shown in FIG. 14B, it is possible to make only toner Ts having a grain diameter which is smaller than the volume average grain diameter Dave to be supported on the convex portion 441. Since the toner having a small grain diameter is subjected to the action of strong image force due to a small diameter, it scarcely departs from the developing roller 44, and also, since the electrification amount is further increased due to the contact with the regulating blade 46, scattering or fogging can be reliably prevented by adhering only such toner to the convex portion. In addition, in this embodiment, since frictional electrification of toner by the regulating blade 46 is not expected, it is not necessary to press the regulating blade 46 against the developing roller 44 with high load, and the regulating load is about 5 gf/cm. With a load of such an extent, filming due to the pressing of toner of the convex portion 441 against the regulating blade 46 does not matter.

On the other hand, in order to obtain the effect of suppressing electrification variation in the concave portion 442, it is necessary to make the toner layer in the concave portion 442 be larger than one layer and smaller than two layers. This is because that in the toner layer which is equal to or less than one layer, over-charging occurs, and if it exceeds two layers, toner which does not come into contact with any of the developing roller 44 and the regulating blade 46 appears. Since a distance Hp between the concave portion 442 and the regulating blade 46 is a distance that added the distance between the convex portion 441 and the regulating blade 46, namely, the opening height Ho and the difference in height, Hd, between the convex portion 441 and the concave portion 442, it is preferable that the value Hp be a value which is larger than 1 time of the volume average grain diameter Dave of toner and smaller than 2 times.

Also, it is confirmed that an effect also varies in accordance with the surface treatment of the developing roller 44, and, for example, in a case where the developing roller 44 was made of iron, when the surface was subjected to amorphous non-electrolytic plating treatment, an excellent result was obtained. As preferable treatment, nickel phosphorus plating treatment, nickel tungsten plating treatment, nickel boron tungsten plating treatment, chrome carbide plating treatment, and the like can be given as an example. In an developing roller with a surface coated by such an amorphous material, it is considered that due to rubbing by the supply roller 43, frictional electrification of toner easily occurs, and also, it is confirmed that the electrification amount of the toner which is fed to the contact position with the regulating blade 46 is increased, so that the adjustment of the electrification amount by the regulating bias voltage Vrb functions more effectively.

Also, when the developing roller 44 is made of aluminum, if the surface is subjected to alumite treatment, a thin insulating film is formed on the surface of the developing roller 44, so that insulation resistance between the developing roller 44 and the regulating blade 46 can be increased, and in particular, even in toner having a small grain diameter or toner having high conductive property due to the high content of carbon black pigment, it is possible to secure insulation withstanding voltage while preventing current leakage, and also, it is possible to increase with good controllability the electrification amount of toner by applying sufficient regulating bias voltage. This is effective for suppression of scattering or fogging in small grain diameter or high pigment content toner which is poor in insulation property.

Also, in the case of a toner in which normal electrification polarity is negative polarity, as in the embodiment, it is also effective to use an electrically-conductive external additive particle on which an aminosilane thin film was formed in advance by surface treatment, as an electrically-conductive external additive particle which is added to toner. It is known that the aminosilane film receives cation, thereby being easily electrically charged so as to have positive polarity, and since such positive charges exist in the surface of the electrically-conductive external additive, thereby being attracted by negative regulating bias voltage applied to the regulating blade 46, the effect of more reliably bringing the electrically-conductive external additives into contact with the regulating blade 46 can be effectively increased.

Also, according to an idea of the invention, the toner mother particle itself does not necessarily need conductive property, and from the viewpoint of the suppression of fogging, rather, low conductive property is preferable in that electrification control by the electrically-conductive external additive is easily performed. In this regard, it is also acceptable to use toner produced by a polymerization method in which it is possible suppress conductive property to a low level by coating pigment by resin.

As described above, in this embodiment, the photo conductor 22, the developing roller 44, and the regulating blade 46 respectively function as a "latent supporting body", a "toner supporting roller", and a "regulating blade" of the invention. Also, the developing devices 4Y, 4M, 4C, and 4K, which are provided with them, correspond to a "developing apparatus" of the invention. Also, the electric source 141 for a regulating bias functions as a "bias applying section" of the invention.

Also, the invention is not to be limited to the above-described embodiment, but it is possible to perform various changes other than the aforementioned within a scope that does not depart from the purpose of the invention. For example, the above-described embodiment is an image forming apparatus of a so-called jumping development system in which the photo conductor 22 and the developing roller 44 are disposed so as to face each other with a given gap kept therebetween and toner flies between both members. However, it is also possible to apply the invention to an apparatus in which an alternating-current developing bias is applied in a state where both members come into contact with each other.

Also, for example, the convex portion 441 of the developing roller 44 of the above-described embodiment is formed into an approximately rhombic shape. However, the shape thereof is not to be limited to this, but the convex portion may also be configured to have, for example, a circular shape, a triangular shape, or the other shapes. Also, the shapes of the respective convex portions do not need to be the same, but convex portions having different shapes may also be mixed and exist. However, in any event, in order to obtain a toner layer control effect concerned with the invention, a structure is preferable in which at least the top surface of each convex portion constitutes a portion of the same cylindrical surface, and also, it is preferable that the depth of the concave portion be approximately constant. In this regard, a structure is particularly effective in which concave and convex portions are formed by inscribing concavity and convexity in a cylindrical surface which is originally smooth.

Also, the invention is not limited to a configuration in which regular concave and convex portions are provided in the surface of the developing roller, as in the above-described embodiment, but, even in an apparatus which uses a developing roller having another surface structure such as a structure having a surface subjected to, for example, blasting work, if it has a configuration of using regulating bias voltage which is applied to a regulating blade, it is possible to suitably apply the technical idea described above. However, in a developing roller subjected to blasting work, since random concave and convex portions are formed in the surface, it is difficult to manage microscopically the thickness of a toner layer. Further, since the distance between a developing roller and a regulating blade is also random, it is considered that it is difficult selectively to bring only toner, which does not come into contact with the developing roller, into contact with the regulating blade, as in the above-described embodiment. In these regards, it can be said that the above-described roller provided with regular concave and convex portions is more preferable.

Also, although the image forming apparatus of the above-described embodiment is a color image forming apparatus in which the developing device 4K and the like are mounted in the rotary developing unit 4, an object to which the invention is applied is not to be limited to this. It is also possible to apply the invention to, for example, a color image forming apparatus of a so-called tandem system in which a plurality of developing devices are arranged along the intermediate transfer belt, or a monochromatic image forming apparatus which is provided with only one developing device, thereby forming a monochromatic image.

The entire disclosure of Japanese Patent Application No. 2009-070843, filed Mar. 23, 2009 is expressly incorporated by reference herein.

What is claimed is:

1. A developing apparatus comprising:

a housing which contains toner in the interior thereof;

a toner supporting roller which is mounted by shafts in the housing and rotates while supporting electrification toner which is supplied from the housing to the surface thereof; and an electrically-conductive regulating blade which comes into contact with the surface of the toner supporting roller, thereby regulating the amount of toner which is supported on the surface of the toner supporting roller, wherein regulating bias voltage having the same polarity as the electrification polarity of the toner is applied to the regulating blade, the toner includes, as external additives, an insulating external additive and an electrically-conductive external additive that is higher in conductive property than the insulating external additive, and in addition, satisfies any of the following first to third conditions, the first condition: a volume average grain diameter of the electrically-conductive external additive is larger than a volume average grain diameter of the insulating external additive, the second condition: a volume average grain diameter of the electrically-conductive external additive is larger than a volume average grain diameter of the insulating external additive in which coverage in the toner is higher than that of the electrically-conductive external additive, and the third condition: coverage of the electrically-conductive external additive in the toner is higher than coverage of the insulating external additive that is larger in volume average grain diameter than the electrically-conductive external additive.

2. The developing apparatus according to claim 1, wherein the toner includes, as the electrically-conductive external additive, at least one of titanium oxide, aluminum oxide, zinc oxide, cerium oxide, tin oxide, and strontium titanate.

3. The developing apparatus according to claim 1, wherein the toner supporting roller is formed in its surface with a plurality of convex portions, in which the top surfaces of the respective convex portions mutually constitute portions of the same cylindrical surface, and concave portions which surround the convex portion.

4. The developing apparatus according to claim 1, wherein the toner supporting roller is a metallic roller having a surface coated with an amorphous material.

5. The developing apparatus according to claim 1, wherein the electrification polarity of the toner is negative polarity, and the electrically-conductive external additive is formed on its surface with an aminosilane film.

6. An image forming apparatus comprising:

a toner supporting roller which rotates while supporting electrification toner on the surface thereof;

an electrically-conductive regulating blade which comes into contact with the surface of the toner supporting roller, thereby regulating the amount of toner which is supported on the surface of the toner supporting roller;

a bias applying section which applies regulating bias voltage having the same polarity as the electrification polarity of the toner to the regulating blade; and a latent image supporting body which is disposed so as to face the toner supporting roller and supports an electrostatic latent image on the surface thereof, wherein the toner includes, as external additives, an insulating external additive and an electrically-conductive external additive that is higher in conductive property than the insulating external additive, and in addition, satisfies any of the following first to third conditions, the first condition: a volume average grain diameter of the electrically-conductive external additive is larger than a volume average grain diameter of the insulating external additive, the second condition: a volume average grain diameter of the electrically-conductive external additive is larger than a volume average grain diameter of the insulating external additive in which coverage in the toner is higher than that of the electrically-conductive external additive, and the third condition: coverage of the electrically-conductive external additive in the toner is higher than coverage of the insulating external additive that is larger in volume average grain diameter than the electrically-conductive external additive.

7. Toner that is used in a developing apparatus which makes a toner layer to be supported on the surface of a toner supporting roller by bringing an electrically-conductive regulating blade applied with a given regulating bias voltage into contact with the surface of the toner supporting roller, the toner having electrification polarity which is the same polarity as that of the regulating bias voltage, including, as external additives, an insulating external additive and an electrically-conductive external additive that is higher in conductive property than the insulating external additive, and in addition, satisfying any of the following first to third conditions, the first condition: a volume average grain diameter of the electrically-conductive external additive is larger than a volume average grain diameter of the insulating external additive, the second condition: a volume average grain diameter of the electrically-conductive external additive is larger than a volume average grain diameter of the insulating external additive in which coverage in the toner is higher than that of the electrically-conductive external additive, and the third condition: coverage of the electrically-conductive external additive in the toner is higher than coverage of the insulating external additive that is larger in volume average grain diameter than the electrically-conductive external additive.

* * * * *